US007484497B2

(12) United States Patent
Watanabe et al.

(10) Patent No.: US 7,484,497 B2
(45) Date of Patent: Feb. 3, 2009

(54) CONTROL DEVICE FOR AN INTERNAL COMBUSTION ENGINE

(75) Inventors: Shinji Watanabe, Tokyo (JP); Toru Tanaka, Tokyo (JP); Tatsuhiko Takahashi, Hyogo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 11/966,199

(22) Filed: Dec. 28, 2007

(65) Prior Publication Data

US 2008/0288155 A1 Nov. 20, 2008

(30) Foreign Application Priority Data

May 18, 2007 (JP) ..... 2007-132840

(51) Int. Cl.
*F02D 13/00* (2006.01)
*F01L 9/02* (2006.01)

(52) U.S. Cl. ..... 123/345; 123/90.12; 123/90.31; 123/321

(58) Field of Classification Search ..... 123/90.1, 123/90.12, 90.15, 90.16, 90.17, 90.18, 90.31, 123/321, 322, 345, 346, 347, 348
See application file for complete search history.

(56) References Cited

U.S. PATENT DOCUMENTS

| | | | | |
|---|---|---|---|---|
| 6,691,022 | B2 * | 2/2004 | Takemura et al. | 701/109 |
| 6,792,901 | B2 * | 9/2004 | Sugiyama et al. | 123/90.15 |
| 6,971,350 | B2 * | 12/2005 | Akasaka et al. | 123/90.16 |
| 7,403,849 | B1 * | 7/2008 | Watanabe et al. | 701/102 |
| 2003/0041823 | A1 * | 3/2003 | Takemura et al. | 123/90.16 |
| 2003/0196622 | A1 * | 10/2003 | Wada et al. | 123/90.17 |
| 2004/0083999 | A1 * | 5/2004 | Miyakoshi et al. | 123/90.17 |
| 2005/0188931 | A1 * | 9/2005 | Akasaka et al. | 123/90.16 |
| 2006/0207534 | A1 * | 9/2006 | Machida | 123/90.16 |

FOREIGN PATENT DOCUMENTS

JP 2001-234765 A 8/2001

* cited by examiner

*Primary Examiner*—John T Kwon
(74) *Attorney, Agent, or Firm*—Sughrue Mion, PLLC

(57) ABSTRACT

Provided is a control device for an internal combustion engine, including a crank angle sensor, a cam angle sensor, a real phase angle detector for detecting a real phase angle of a cam shaft based on a detection signal of the sensors, a target phase angle setting unit including a temperature parameter and battery voltage, for setting a target phase angle of the cam shaft based on an operating state of the internal combustion engine, and a phase angle feedback control unit for conducting feedback control operation so that the real phase angle coincides with the target phase angle, and for calculating an operation quantity to a hydraulically controlled solenoid valve, in which the feedback control unit sets an integral term initial value when starting the feedback control operation according to the temperature parameter, corrects a control correction quantity by the battery voltage, and outputs the operation quantity to the solenoid valve.

11 Claims, 19 Drawing Sheets

CONTROL DEVICE FOR AN INTERNAL COMBUSTION ENGINE

BACKGROUND OF THE INVENTION

1. Field of the Invention

The present invention relates to a control device for an internal combustion engine for controlling the operation timing of an intake valve or an exhaust valve in the internal combustion engine.

2. Description of the Related Art

Up to now, there has been known a valve timing control device for an internal combustion engine, which changes a phase angle of a cam shaft with respect to a crank shaft in the internal combustion engine to thereby change a valve switching timing of the intake valve or the exhaust valve (for example, refer to JP 2001-234765 A).

The valve timing control device of this type is provided with a crank angle sensor for outputting a crank angle signal at a reference rotation position of the crank shaft, and a cam angle sensor for outputting a cam angle signal at a reference rotation position of the cam shaft. A real phase angle of the cam shaft is detected based on detection signals of the crank angle sensor and the cam angle sensor, and a phase angle feedback control is conducted so that the real phase angle coincides with a target phase angle that is set based on an operation state of the internal combustion engine.

The phase angle of the cam shaft with respect to the crank shaft is changed by a cam shaft phase variable mechanism in which the hydraulic supply is controlled by a hydraulically controlled solenoid valve. The hydraulically controlled solenoid valve is constructed of a duty solenoid valve, and a supply voltage to the solenoid is controlled in duty ratio to control a current value. A hydraulic pressure is selectively supplied to an advance chamber or a delay chamber of the cam shaft phase variable mechanism to change the cam shaft to the advance side or the delay side. Further, when the duty ratio is a retention duty value in the vicinity of the center, the hydraulically controlled solenoid valve closes the advance chamber and the delay chamber at the same time. Then, the hydraulically controlled solenoid valve is controlled to a neutral position where the supply of the hydraulic pressures is cut off at the same time. As a result, the phase angle of the cam shaft is retained.

In order to compensate a variation in the retention duty value with which the hydraulically controlled solenoid valve is set at the neutral position due to a tolerance of the hydraulically controlled solenoid valve or a variation with time, there have been known a method of learning the retention duty value and a method of storing the learned value in a backup RAM. There has also been known a method of using a fixed value that has been stored in a ROM in advance as an initial value when the retention duty value is not learned at all or when the learned value is lost upon, for example, turning off of a battery (disconnection of a battery terminal).

However, because the fixed value of the retention duty set as described above varies in the tolerance and also changes with time, the fixed value may not naturally coincide with the learned value that compensates those variations. For that reason, in the case where such an inconsistency occurs therebetween, the use of the fixed value of the retention duty value as the initial value when the battery is in an off state causes displacement of an actual position of the hydraulically controlled solenoid valve in the retention state from the original neutral position. As a result, the subsequent controllability of the cam phase control is also deteriorated.

In particular, in the case where the inconsistency occurs at the advance side, and a target phase angle is set to the advance side where a valve overlap of the intake valve and the exhaust value is originally large, it is also known that the valve overlap becomes excessive, and an internal exhaust gas recirculation volume (EGR volume) is resultantly excessive, which may deteriorate the combustion quality.

For that reason, in the valve timing control device for an internal combustion as disclosed in JP 2001-234765 A, the learned retention duty value is set as an initial value of an integral term of the feedback control, and in the case where the learning of the retention duty has not yet been completed, the target phase angle is limited.

However, in the valve timing control device for an internal combustion engine disclosed in JP 2001-234765 A, the retention duty fluctuates due to a change in resistance value of a hydraulically controlled solenoid coil or a change in battery voltage, which is attributable to a change in oil temperature. As a result, in the case where a temperature of the hydraulically controlled solenoid coil and the battery voltage at the time of learning the retention duty are different from a temperature and a voltage at the time of setting the learned retention duty value to the initial value of the integral term at the time of starting the phase angle feedback control, the actual value of the retention duty value and the learned value are different from each other.

In the above case, when the learned retention duty value is set to the initial value of the integral term at the time of starting the phase angle feedback control after the internal combustion engine starts, the real position in the retention state of the hydraulically controlled solenoid valve is deviated from the original neutral position. In particular, in the case where the deviation is caused at the advance side, and the target phase angle is set to the advance side where the valve overlap between the intake valve and the exhaust valve is originally large, the valve overlap becomes excessive, and the resultant internal EGR quantity becomes excessive, thereby deteriorating the startability of the internal combustion engine.

Further, in the case where the learning of the retention duty value has not yet been completed, the control of the advance side is limited because the target phase angle is limited. In the internal combustion engine having a valve timing control device that changes the switching timing of the intake valve, in the case where the switching timing is extremely changed to the delay side at the time of starting the internal combustion engine, an intake fuel-air mixture within a combustion chamber is returned into an intake pipe because a close timing of the intake valve is delayed. When the intake fuel-air mixture is returned into the intake pipe at the time of cranking where the rotation speed of the internal combustion engine is extremely low, a real compression ratio is lowered to thereby make the startability difficult. In particular, at a low temperature where the volume of the fuel-air mixture is small, there arises such a problem that the fuel-air mixture is not sufficiently compressed even if cranking is conducted, and the startability is further deteriorated.

SUMMARY OF THE INVENTION

The present invention has been made in view of the above-mentioned circumstances, and therefore an object of the present invention is to provide a control device for an internal combustion engine which sets an initial value of an integral term at a time of starting a phase angle feedback control by a simple control logic, thereby making it possible to achieve both of suppression of an overshoot quantity of a real phase angle and an improvement in a response time.

A control device for an internal combustion engine according to the present invention relates to a valve timing control device for changing a valve switching timing of at least one of an intake valve and an exhaust valve by changing a variable mechanism that enables continuous changing of a rotation phase of a cam shaft with respect to a crank shaft of the internal combustion engine by a hydraulically controlled solenoid valve (OVC) through hydraulic driving. The control device includes: a crank angle sensor for detecting a reference rotation position of the crank shaft; a cam angle sensor for detecting a reference rotation position of the cam shaft; and a real phase angle detecting unit for detecting a real phase angle of the cam shaft based on a detection signal of the crank angle sensor and the cam angle sensor. The control device also includes: a target phase angle setting unit including a temperature parameter and a battery voltage, for setting a target phase angle of the cam shaft based on an operating state of the internal combustion engine; and a phase angle feedback control unit for conducting a feedback control operation so that the real phase angle coincides with the target phase angle, and for calculating an operation quantity with respect to the hydraulically controlled solenoid valve. In the control device, the phase angle feedback control unit sets an initial value of an integral term at a time of starting the phase angle feedback control operation based on the temperature parameter of the internal combustion engine, corrects a control correction quantity that has been calculated by the feedback control operation according to the battery voltage, and outputs the operation quantity with respect to the hydraulically controlled solenoid valve.

According to the present invention, the initial value of the integral term at the time of starting the phase angle feedback control operation is set based on the temperature parameter of the internal combustion engine, and the control correction quantity that has been calculated by the feedback control operation is corrected by the battery voltage so that an operation quantity is output to the hydraulically controlled solenoid valve. As a result, the actual position of the hydraulically controlled solenoid valve in the retention state is not deviated from the original neutral position toward the advance side. Therefore, even in a case where the target phase angle is set to the advance side where the valve overlap between the intake valve and the exhaust valve is originally large, the valve overlap does not become excessive, and deterioration of the startability of the internal combustion engine which is caused by the excessive internal EGR volume (exhaust gas recirculation volume) can be prevented. In addition, because it is unnecessary to limit the target phase angle toward the advance side, it is possible to improve the startability at a low temperature.

DETAILED DESCRIPTION OF THE PREFERRED EMBODIMENTS

First Embodiment

Figure 1:
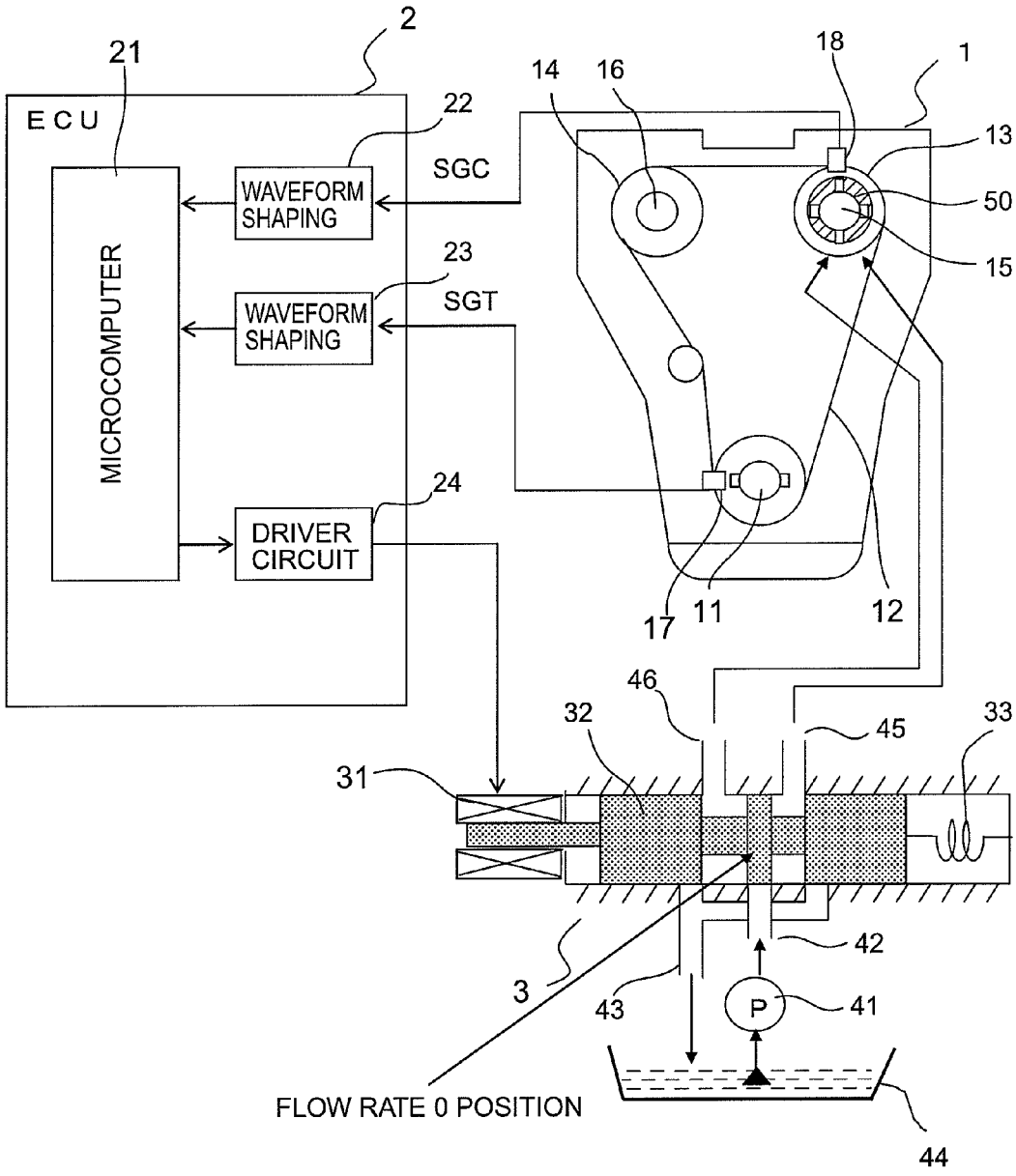
FIG. 1 is a diagram showing an outline structure of a valve timing control device for an internal combustion engine according to the present invention.

Hereinafter, a description will be given of an embodiment of the present invention with reference to the accompanying drawings. FIG. 1 is a diagram showing an outline structure of a valve timing control device for an internal combustion engine according to a first embodiment of the present invention. In a valve timing control device for an internal combustion engine shown in FIG. 1, a driving force is transmitted from a crank shaft 11 of an internal combustion engine 1 to a pair of timing pulleys 13 and 14 through a timing belt 12. The pair of timing pulleys 13 and 14 that are rotationally driven in synchronism with the crank shaft 11 are equipped with a pair of cam shafts 15 and 16 as driven shafts, respectively, and an intake valve and an exhaust valve which are not shown are driven to be opened or closed by those cam shafts 15 and 16.

With the above configuration, the intake valve and the exhaust valve are driven to be opened or closed in synchronism with rotation of the crank shaft 11 and vertical motion of a piston (not shown). That is, the intake valve and the exhaust valve are driven at a given switching timing in synchronism with a sequence of four strokes consisting of an intake stroke, a compression stroke, an explosion (expansion) stroke, and an exhaust stroke in the internal combustion engine 1.

The crank shaft 11 is equipped with a crank angle sensor 17, and the cam shaft 15 is equipped with a cam angle sensor 18, respectively. A crank angle signal SGT that is output from the crank angle sensor 17 and a cam angle signal SGC that is output from the cam angle sensor 18 are input to an electronic control unit (ECU) 2.

In this example, when the crank shaft 11 rotates by one revolution, and when N pulses are generated from the crank angle sensor 17, the number of pulses generated from the cam angle sensor 18 by one revolution of the cam shaft 15 is set to 2N. Further, when it is assumed that a timing conversion angle maximum value of the cam shaft 15 is VTmax° CA (crank angle), the number of pulses is set to meet N≦(360/VTmax). As a result, it is possible to use a pulse signal (crank angle signal SGT) of the crank angle sensor 17 and a pulse signal (cam angle signal SGC) of the cam angle sensor 18 at the time of calculating a real phase angle VTa.

The ECU 2 includes a known microcomputer 21. The microcomputer 21 outputs an operation quantity (duty driving signal) that has been calculated by the aid of phase angle feedback (F/B) control operation to a linear solenoid 31 of a hydraulically controlled solenoid valve (hereinafter referred to as "OCV (oil control valve)") which is a phase angle control actuator through a driver circuit 24. The operation quantity is output to the linear solenoid 31 so that a real phase angle of the cam shaft with respect to the crank shaft 11 which has been detected based on the crank angle signal SGT and the cam angle signal SGC coincides with a target phase angle that has been set based on an operating state of the internal combustion engine.

In the OCV 3, a current value of the linear solenoid 31 is controlled according to the DUTY driving signal from the ECU 2. A spool 32 is so positioned as to balance an urging force of a spring 33. A supply oil passage 42 communicates with any one of a supply oil passage 45 at the delay side and a supply oil passage 46 at the advance side, and an oil within an oil tank 44 is pumped by the aid of a pump 41 to a valve timing control mechanism 50 (a shaded area of FIG. 1) that is provided to the cam shaft 15. An amount of oil that is supplied to the valve timing control mechanism 50 is adjusted in such a manner that the cam shaft 15 is rotatable with a given phase difference with respect to the timing pulley 13, that is, the crank shaft 11, and the cam shaft 15 can be set to the target phase angle. The oil supplied from the valve timing control mechanism 50 is returned to the oil tank 44 through an exhausted oil passage 43.

Figure 2:
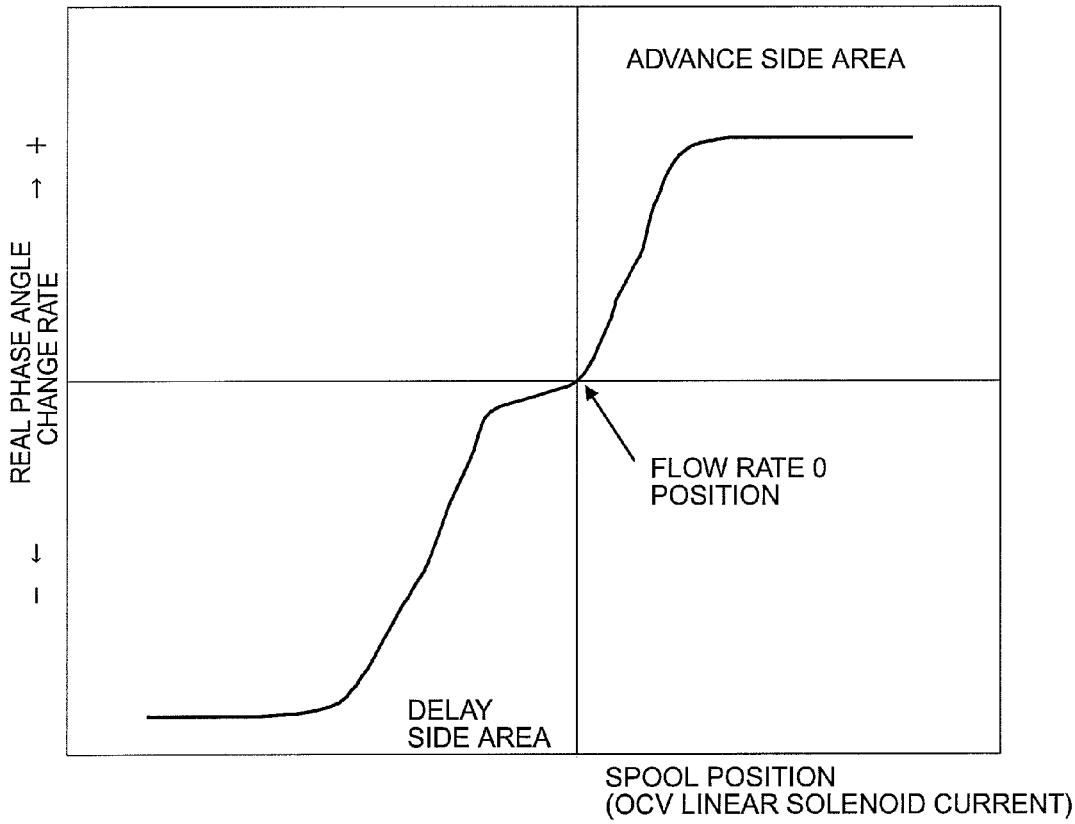
FIG. 2 is a graph showing a relationship between a phase angle change velocity of a phase angle control actuator and a spool position.

FIG. 2 is a characteristic diagram showing a relationship between a position of the spool 32 within the OCV 3 (hereinafter referred to as spool position) and a real phase angle change velocity. In the characteristic diagram, an area in which the real phase angle change velocity is positive corresponds to the advance side area, and another area in which the real phase angle change velocity is negative corresponds to the delay side area. The spool position on the axis of abscissa in the characteristic diagram is in proportion to a linear solenoid current. Further, a spool position at which the supply oil passenger 42 communicates with none of the supply oil passage 45 at the delay side and the supply oil passage 46 at the advance side is a position at which the flow rate is 0 in the figure (a position at which the flow rate that is output from the OCV 3 is 0), which is a spool position (the same as the neutral position) at which the real phase angle does not change. A relationship between the position where the flow rate is 0 and the linear solenoid current value are varied due to an individual difference in the OCV 3 or a difference in the durability deterioration or the operating environment (oil temperature, the engine rotation speed).

Under the circumstances, in the related art (JP 2001-234765 A), the driving duty value obtained when the position state where the flow rate is 0 is controlled at the time of controlling the phase angle feedback is learned as the retention duty value, and set as an initial value of the integral term at the time of starting the phase angle feedback control.

The microcomputer 21 includes a central processing unit (CPU) (not shown) that conducts diverse operations and determinations, a ROM (not shown) in which predetermined control programs have been stored in advance, a RAM (not shown) that temporarily stores operation results from the CPU therein, an A/D converter (not shown) that converts an analog voltage into a digital value, a counter CNT (not shown) that measures a period of an input signal or the like, a timer (not shown) that measures a driving period of an output signal or the like, an output port (not shown) that is an output interface, and a common bus (not shown) that connects the respective blocks (not shown).

Figure 3:
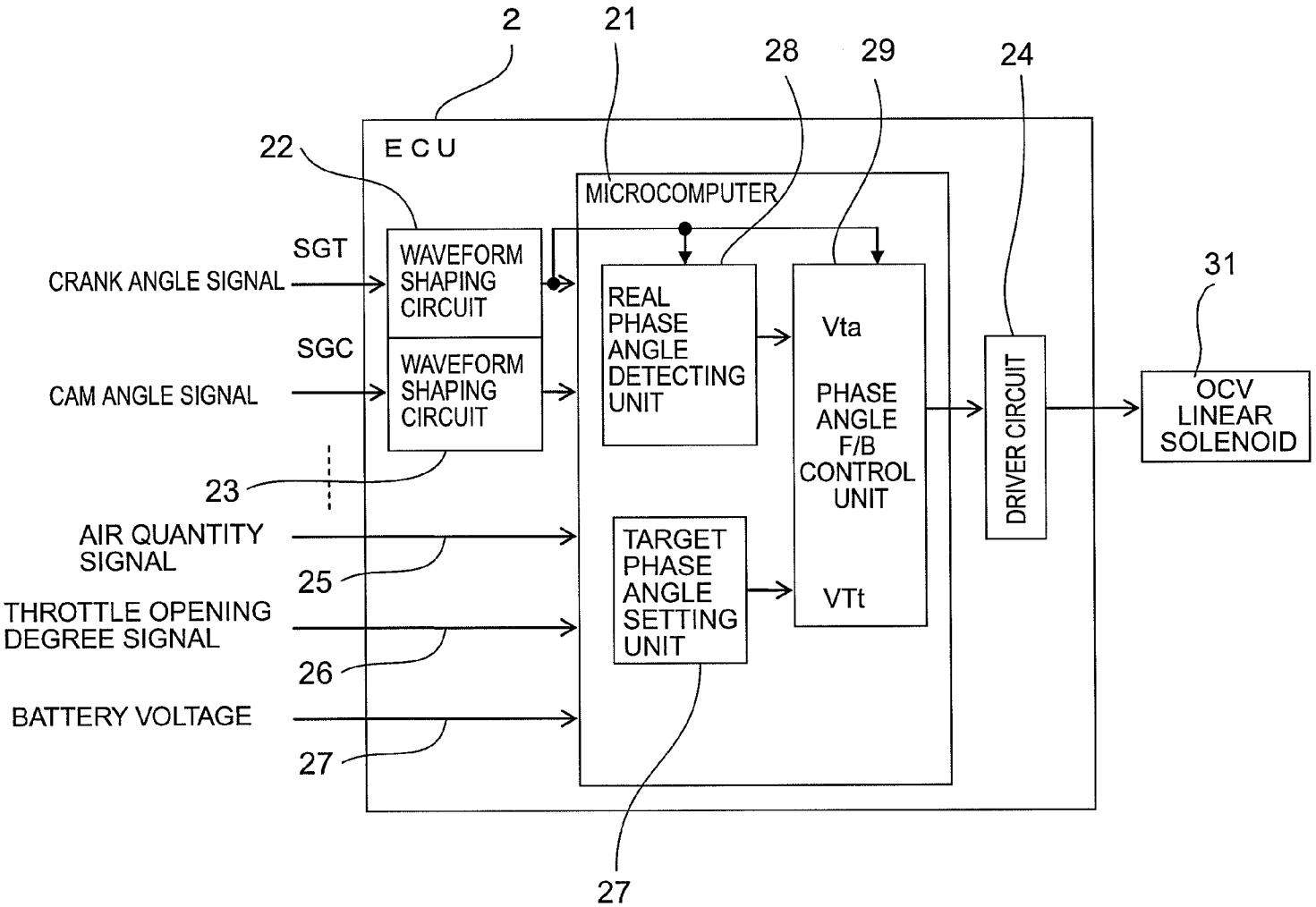
FIG. 3 is a functional block diagram conceptually showing a processing configuration within a microcomputer (21) according to the present invention.
Figure 4:
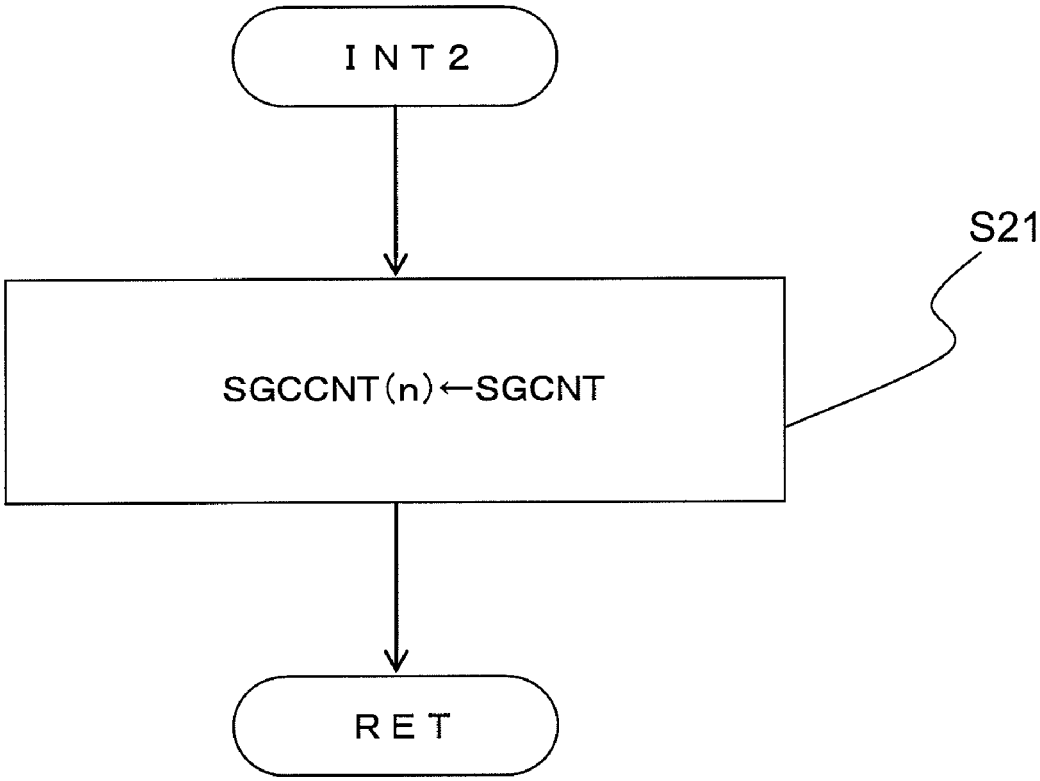
FIG. 4 is a flowchart showing cam angle signal interrupt processing.
Figure 5:
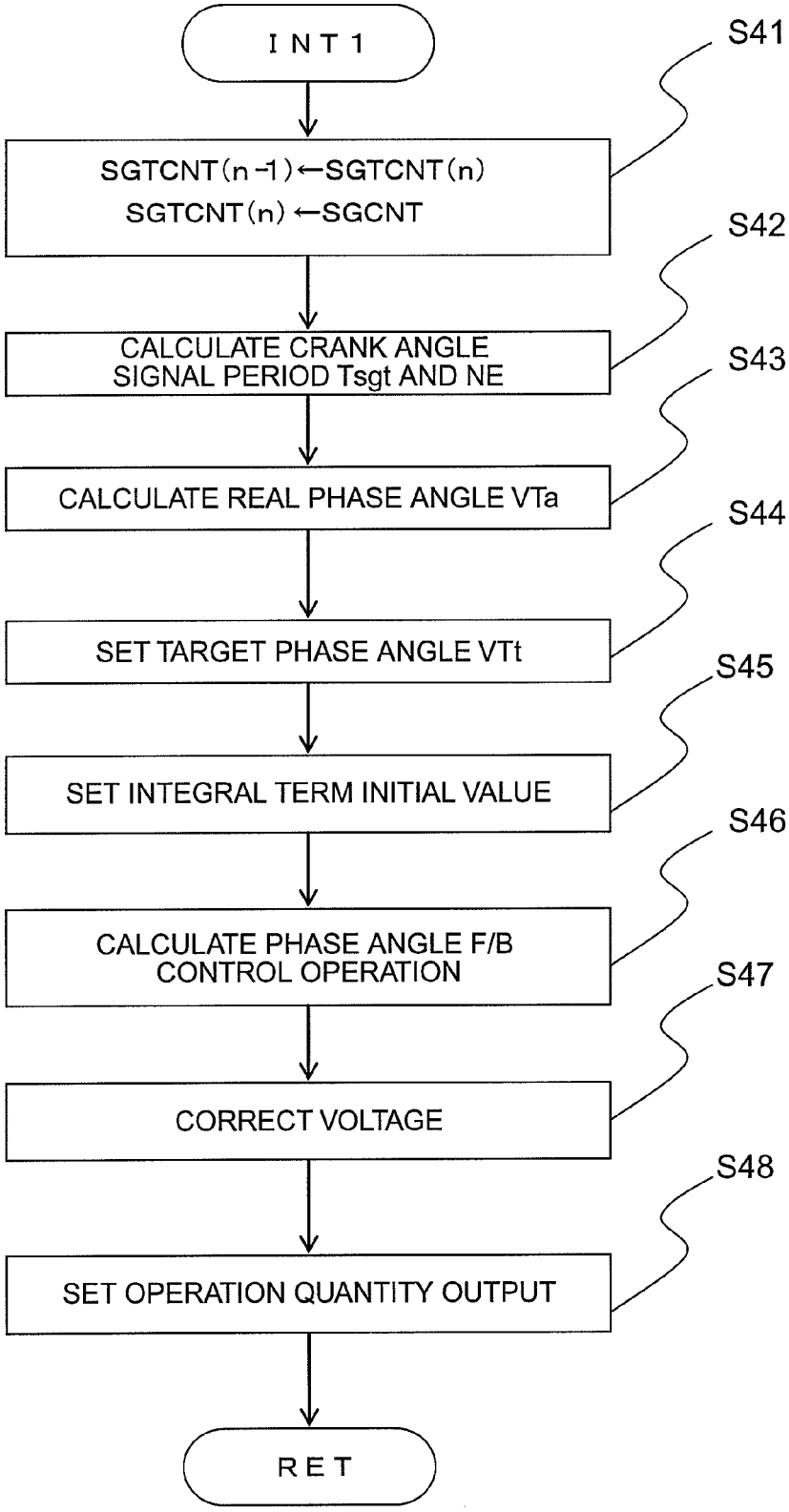
FIG. 5 is a flowchart showing crank angle signal interrupt processing according to the present invention.

FIG. 3 is a functional block diagram conceptually showing a basic configuration within the microcomputer 21 for the valve timing control in the internal combustion engine according to the first embodiment of the present invention, which shows the function of the operating program within the microcomputer 21. Hereinafter, the processing within the microcomputer 21 will be described with reference to the respective flowcharts of FIG. 4 showing the interrupt processing of the cam angle signal SGC and FIG. 5 showing the interrupt processing of the crank angle signal SGT together with FIG. 3.

The cam angle signal SGC from the cam angle sensor 18 is shaped in the waveform through a waveform shaping circuit 23, and then input to the microcomputer 21 as an interrupt command signal INT2. The microcomputer 21 reads a counter value SGCNT of the counter CNT (not shown), and stores the read counter value SGCNT in the RAM (not shown) of the SGCCNT(n) every time interrupt is effected by the interrupt command signal INT2 (Step S21 of FIG. 4).

Further, the crank angle signal SGT from the crank angle sensor 17 is shaped in the waveform through a waveform shaping circuit 22, and then input to the microcomputer 21 as an interrupt command signal INT1. The microcomputer 21 reads a counter value SGTCNT(n) obtained when the crank angle signal SGT is previously input to the microcomputer 21, from the RAM, and then stores the read counter value SGTCNT(n) in the RAM of the SGTCNT(n−1) every time interrupt is effected by the interrupt command signal INT1. Then, the microcomputer 21 reads the counter value SGCNT of the counter CNT obtained when the crank angle signal SGT is input at this time, and stores the read counter value SGCNT in the RAM of the SGTCNT(n) (Step S41 of FIG. 5).

Further, the microcomputer 21 calculates a period Tsgt{=SGTCNT(n)−SGTCNT(n−1)} of the crank angle signal SGT according to a difference between the counter value SGTCNT (n−1) of the counter CNT obtained when the crank angle signal SGT is previously input and the counter value SGTCNT(n) of the counter CNT obtained when the crank angle signal SGT is input at this time. Further, the microcomputer 21 calculates a rotation speed NE of the internal combustion engine based on the crank angle signal period Tsgt (Step S42 of FIG. 5).

Then, the microcomputer 21 reads the counter value SGCCNT(n) obtained when the cam angle signal SGC is input to the microcomputer 21, from the RAM (not shown). The microcomputer 21 then calculates a phase difference time ΔTd (the phase difference time at the time of the most delay) or ΔTa (the phase difference time at the time of the advance) according to a difference between the read counter value SGCCNT(n) and the counter value SGTCNT(n) obtained when the crank angle signal SGT is input to the microcomputer 21. Then, the microcomputer 21 calculates a real phase angle Vta whose calculating method will be described in more detail later based on the period Tsgt of the crank angle signal SGT and a reference crank angle (180° CA) (Step S43 of FIG. 5).

Further, the microcomputer 21 subjects an air quantity signal 25, a throttle opening degree signal 26, a battery voltage signal 27, or a water temperature signal (not shown) and the like to removal or amplification processing of noise components through an input I/F circuit (not shown). Then, the microcomputer 21 inputs the processed signal to an A/D converter (not shown), and the input signals are converted into digital data. The microcomputer 21 sets a target phase angle VTt by the aid of a target phase angle setting unit 27 based on the air quantity data, the rotation speed data of the internal combustion engine, or the like (Step S44 of FIG. 5).

The microcomputer 21 calculates and sets the initial value of the integral term at the time of starting the phase angle feedback control when the engine starts, based on the water temperature signal TWT by the aid of the first or second operational expression (Step S45 of FIG. 5). The details of the initial value setting process of the integral term will be described with reference to FIG. 10.

The microcomputer 21 calculates a control correction quantity Dpid through the phase angle F/B control operation (PID control operation) by the aid of a phase angle F/B control unit 29 so that the real phase angle VTa that has been detected by a real phase angle detecting unit 28 based on the crank angle signal SGT and the cam angle signal SGC coincides with the target phase angle VTt that has been set by the target phase angle setting unit 27 based on the air quantity data or the rotation speed data of the internal combustion engine (Step S46 of FIG. 5).

Then, the microcomputer 21 corrects the control correction quantity Dpid that has been calculated through the phase angle F/B control operation by a battery voltage correction coefficient KVB that has been found by a ratio of a given reference voltage to the battery voltage to calculate the operation quantity Dout (driving DUTY value)(Step S47 of FIG. 5).

The microcomputer 21 sets the operation quantity Dout (driving DUTY value) thus calculated in a pulse width modulation (PWM) timer (not shown) (Step S48 of FIG. 5) to output a PWM driving signal that is output from the PWM timer in each of predetermined PWM driving periods to the OCV linear solenoid 31 through the driver circuit 24.

Figure 6:
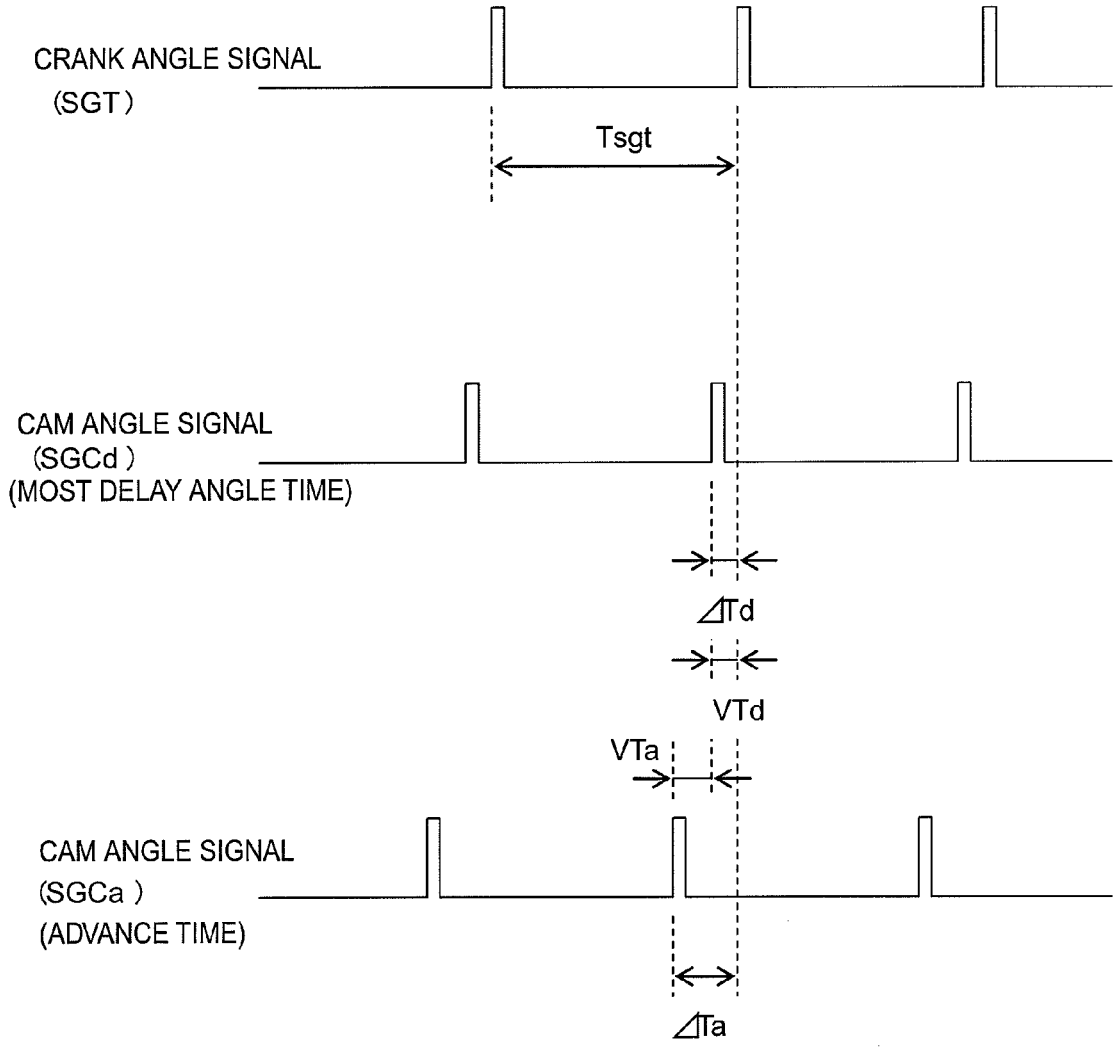
FIG. 6 is a timing chart showing a crank angle signal, a cam angle signal at the most delay, and the cam angle signal at the advance.

Subsequently, a description will be given of a method of detecting the real phase angle VTa by the aid of the real phase detecting unit 28 with a relative phase angle of the cam shaft 15 with respect to the crank shaft 11 taken as the real phase angle, based on the crank angle signal SGT and the cam angle signal SGC with reference to FIG. 6. FIG. 6 is a timing chart showing a relationship of the crank angle signal SGT, a cam angle signal SGCd at the most delay, and a cam angle signal SGCa at the advance. The phase relationship of the crank angle signal SGT, the cam angle signal SGCd at the most delay, and the cam angle signal SGCa at the advance, and the method of calculating the real phase angle VTa are shown in the figure.

The microcomputer 21 measures the period Tsgt{=SGTCNT(n)−SGTCNT(n−1)} of the crank angle signal SGT, and also measures a phase difference time ΔTa{=SGTCNT(n)−SGCCNT(n)} between the cam angle signal SGCa at the advance and the crank angle signal SGT. Further, the microcomputer 21 finds the most delay valve timing VTd based on the phase difference time ΔTd{=SGTCNT(n)−SGCCNT(n)} that has been measured in the case where the valve timing is in the most delay state, and the crank angle signal period Tsgt through the following expression (1), and then stores the most delay valve timing VTd in the RAM within the microcomputer 21.

$$VTd=(\Delta Td/Tsgt)\times 180(^\circ\ \mathrm{CA}) \tag{1}$$

where 180 (° CA) is a reference crank angle at which the SGT signal of the four-cylinder internal combustion engine is generated.

Further, the microcomputer 21 finds the real phase angle VTa based on the phase difference time ΔTa at the time of advance, the crank angle signal period Tsgt, and the most delay valve timing VTd through the following expression (2).

$$VTa=(\Delta Ta/Tsgt)\times 180(^\circ\ \mathrm{CA})-VTd \tag{2}$$

Figure 7:
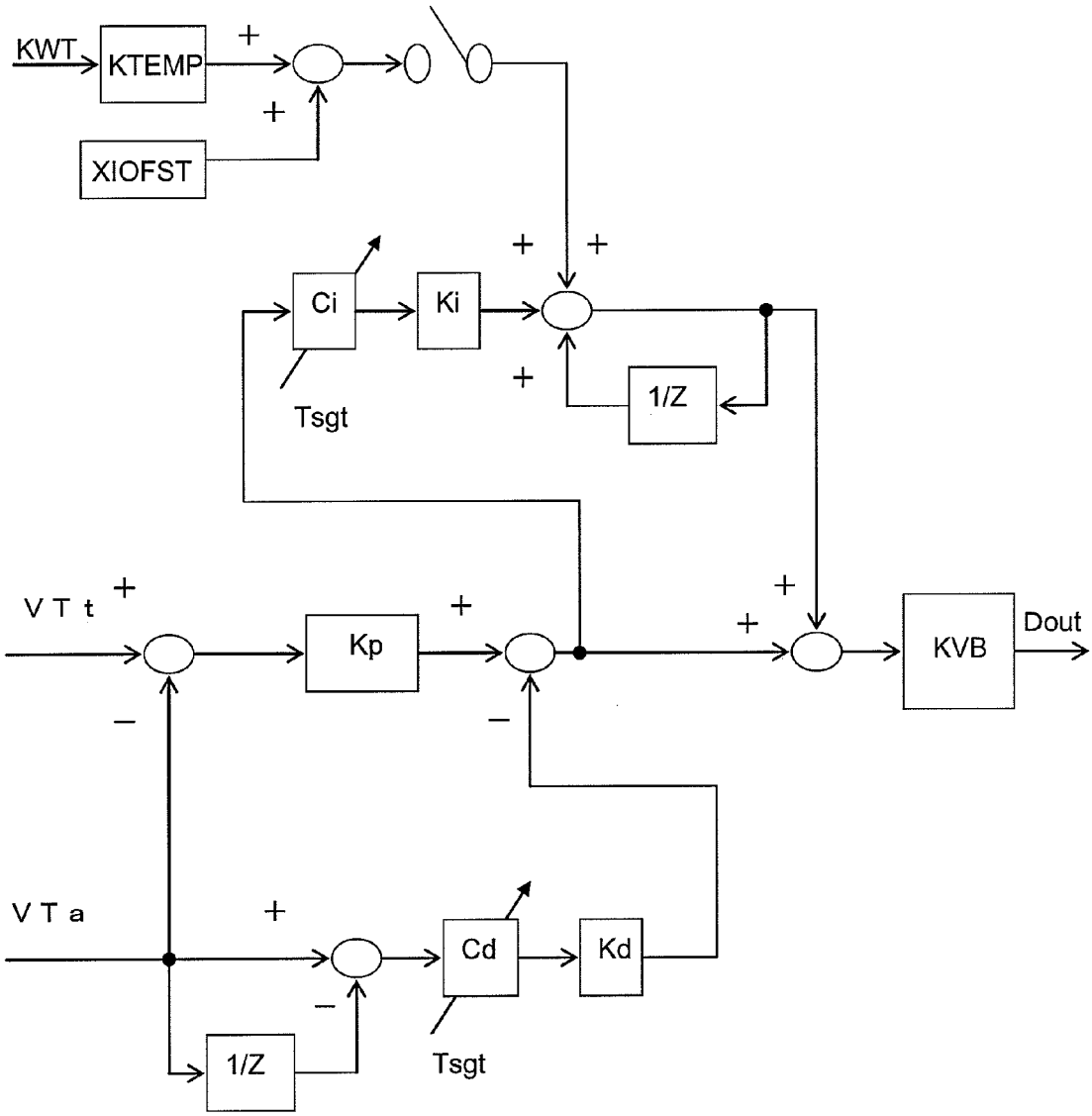
FIG. 7 is a block diagram showing a PID control in a phase angle F/B control according to the present invention.

FIG. 7 shows a block diagram of the PID control in the case where the phase angle F/B control according to the first embodiment is synchronized with the crank angle signal SGT, and the phase angle F/B control operation by the phase angle F/B control unit 29 is conducted by the PID control operation every time the crank angle signals SGT are input. In the PID control block diagram of FIG. 7, the control block of 1/Z indicates a known hold element with one sample delay. Further, the microcomputer 21 calculates and sets the initial value (XI_ini) of the integral term of the PID control through the following first operational expression using the water temperature data (TWT), the temperature coefficient (KTEMP), and the offset value (XIOFST) at the time of starting the phase angle F/B control.

$$XI_ini=K\mathrm{TEMP}\times TWT+XIOFST$$

Subsequently, the PID control operation processing will be described. In order to make the real phase angle VTa that has been detected through Expression 2 based on the crank angle signal SGT and the cam angle signal SGC follow the target phase angle VTt that has been set according to the operation state of the internal combustion engine, the microcomputer 21 first finds a phase angle deviation EP between the target phase angle VTt and the real phase angle VTa through Expression 3.

$$EP=VTt-Vta \tag{3}$$

The microcomputer 21 finds a change rate DVTa of the real phase angle VTa based on the real phase angle VTa(n) that has been detected at the present crank angle signal SGT(n) timing and the real phase angle VTa(n−1) that has been detected at the previous crank angle signal SGT(n−1) timing through Expression 4.

$$DVTa=VTa(n)-Vta(n-1) \tag{4}$$

where (n) and (n−1) are the present and previous real phase angle detection timings.

The microcomputer 21 calculates the control correction quantity Dpid based on the control deviation EP of the phase angle and the change rate DVTa of the real phase angle through the PID control operational expression of Expression 5.

$$Dpid=XP+XI-XD \tag{5}$$

where XP is a proportional term operation value, XI is an integral term operation value, and XD is a differential term operation value.

The microcomputer 21 finds the proportional term operation value XP based on the phase angle deviation EP and a proportional gain Kp through Expression 6.

$$XP=Kp\cdot EP \tag{6}$$

The microcomputer 21 finds the integral term operation value XI by adding the present addition value calculated by the product of a subtraction value of the proportional term XP and the differential term XD, a first normalized coefficient Ci (that will be described later), and an integral gain Ki to the previous integral term operation value XI(n−1) as represented by Expression 7.

$$XI=(XP-XD)\cdot Ci\cdot Ki+XI(n-1) \quad (7)$$

The microcomputer 21 finds the initial value XI_ini of the integral term at the time of starting the phase angle F/B control based on a water temperature KWT, a predetermined temperature coefficient KTEMP, and an offset value XIOFST through Expression 8, and sets the calculated initial value as the previous integral term operation value XI(n−1).

$$XI_ini=KWT\cdot KTEMP+XIOFST \quad (8)$$

The microcomputer 21 finds the differential term operation value XD based on the product of the change rate DVTa of the real phase angle, a second normalized coefficient Cd (that will be described later), and a differential gain Kd, as represented by Expression 9.

$$XD=DVTa\cdot Cd\cdot Kd \quad (9)$$

The microcomputer 21 finds the first normalized coefficient Ci in the integral term operational expression of the above Expression 7 based on the crank angle signal period Tsgt and a given reference period Tbase (for example, 15 msec) as represented by Expression 10.

$$Ci=Tsgt/Tbase \quad (10)$$

Figure 8:
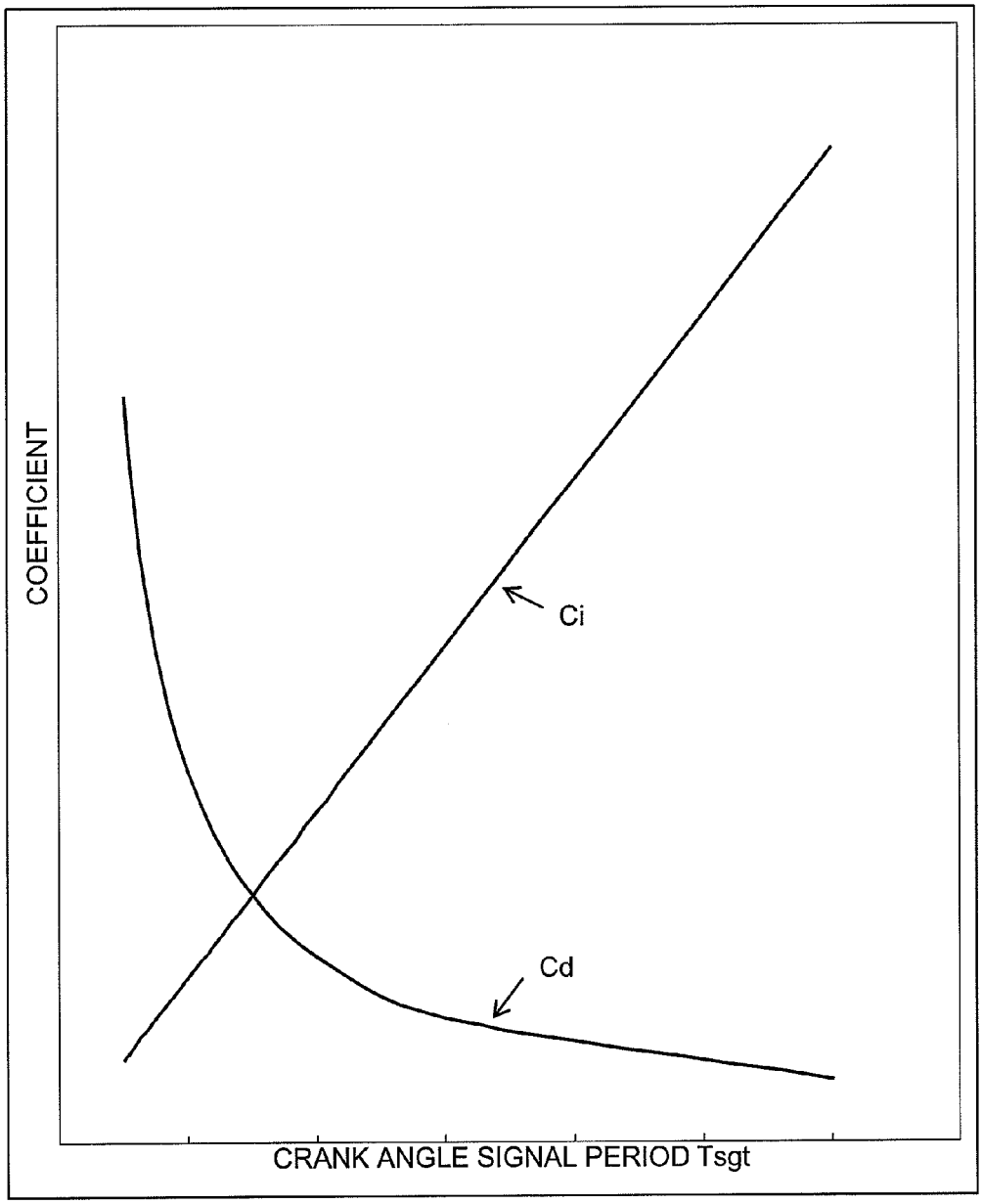
FIG. 8 is a graph showing a relationship between a crank angle signal period and normalized coefficients Ci and Cd according to the present invention.

FIG. 8 shows a relationship between the first normalized coefficient Ci that is found through the above Expression 10 and the crank angle signal period Tsgt. As shown in FIG. 8, the first normalized coefficient Ci is also changed in proportion to the crank angle signal period Tsgt. Therefore, even if the phase angle F/B control operation period is changed due to a change in the crank angle signal period Tsgt whereas the phase angle deviation EP has the same value, it is possible to make the correction quantity of the operation quantity due to the integral term identical by the aid of the first normalized coefficient Ci. As a result, there occurs no excess or deficiency of the integral term correction quantity due to a change in the crank angle signal period Tsgt. For that reason, it is possible to suppress the overshoot quantity or the undershoot quantity while ensuring the response of the real phase angle, and it is possible to synchronize the phase angle F/B control with the crank angle signal SGT.

The microcomputer 21 finds the second normalized coefficient Cd in the differential term operational expression of the above Expression 9 based on the given reference period Tbase and the crank angle signal period Tsgt through Expression 11.

$$Cd=Tbase/Tsgt \quad (11)$$

FIG. 8 shows a relationship between the second normalized coefficient Cd that is found by the above Expression 11 and the crank angle signal period Tsgt. As shown in FIG. 8, since the second normalized coefficient Cd also changes in reverse proportion to the crank angle signal period Tsgt, the phase angle F/B control operation period changes due to a change in the crank angle signal period Tsgt whereas the real phase angle change rate has the same value. Then, even if the change rate DVTa detected value of the real phase angle is changed, it is possible to make the correction quantity of the operation quantity due to the differential term identical by the aid of the second normalized coefficient Cd. As a result, there occurs no excess or deficiency of the integral term correction quantity due to a change in the crank angle signal period Tsgt. For that reason, it is possible to suppress the overshoot quantity or the undershoot quantity while ensuring the response of the real phase angle, and it is possible to synchronize the phase angle F/B control with the crank angle signal SGT.

Subsequently, the microcomputer 21 corrects the control correction quantity Dpid that has been calculated through the above PID control operation by unit of the battery voltage correction coefficient KVB (=a given reference voltage/VB) through Expression 12 so as not to be affected by the fluctuation of the battery voltage VB, calculates the operation quantity Dout, and outputs the calculated operation quantity Dout to the OCV linear solenoid 31 through the driver circuit 24.

$$Dout=Dpid\cdot KVB \quad (12)$$

Figure 9:
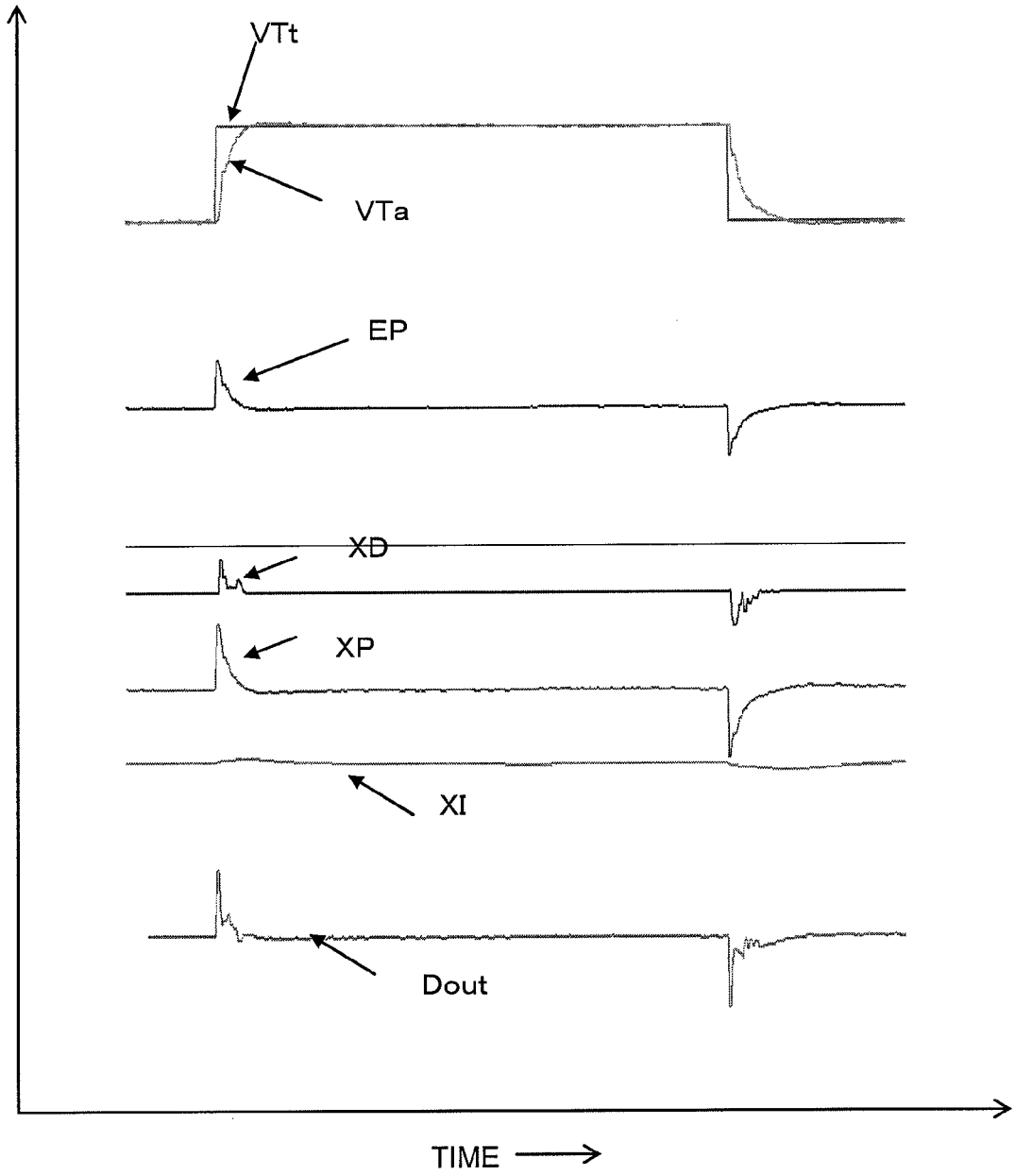
FIG. 9 is a timing chart of the phase angle F/B control according to the present invention.

FIG. 9 shows a timing chart of the phase angle F/B control conducted through the PID control operation. FIG. 9 shows the response operation waveform of the real phase angle Vta at the time of changing the target phase angle VTt to a given value in a stepwise fashion, and the change waveforms of the phase angle control deviation EP, the proportional term operation value XP, the differential term operation value XD, the integral term operation value XI, and the operation quantity Dout which are calculated through the PID control operation. The following facts are found from FIG. 9. That is, the correction quantity XP that is in proportion to the phase angle control deviation EP due to the proportional term at the time of changing the target phase angle VTt corrects the operation quantity Dout in an incremental direction. When the real phase angle Vta starts to move, the correction quantity XD corresponding to the real phase angle change rate DVTa due to the differential term corrects the operation quantity Dout in a decremental direction. The correction quantity XI obtained by integrating a difference between the proportional term operation value XP and the differential term operation value XD due to the integral term increases or decreases the operation quantity Dout. As a result, control is so made as to hold the spool position 32 of the OCV 3 to the position where the flow rate is 0 when the real phase angle VTa is converged to the target phase angle VTt, while the overshoot quantity of the real phase angle Vta is suppressed.

Figure 10:
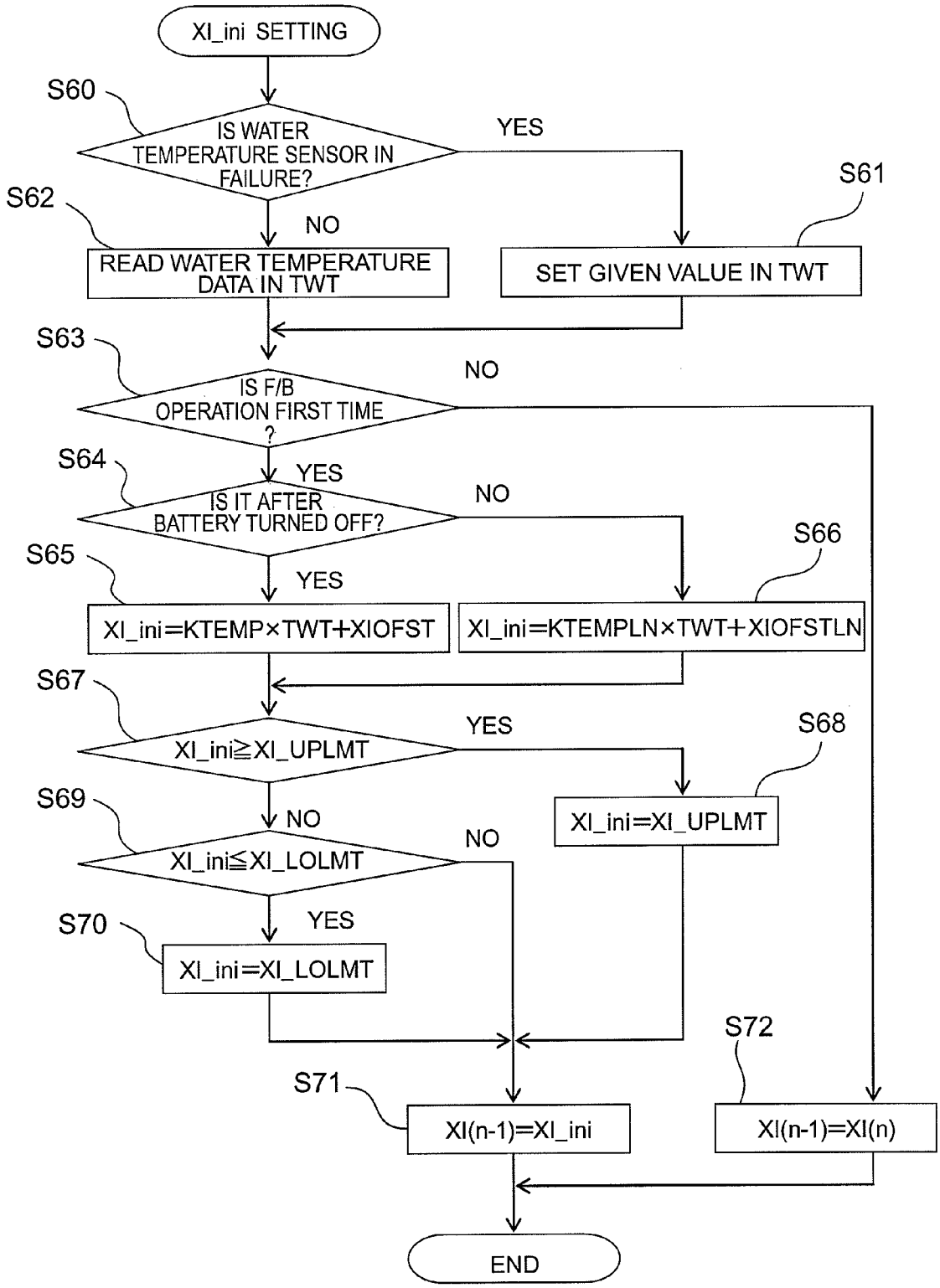
FIG. 10 is a flowchart showing integral term initial value setting processing according to the present invention.
Figure 11:
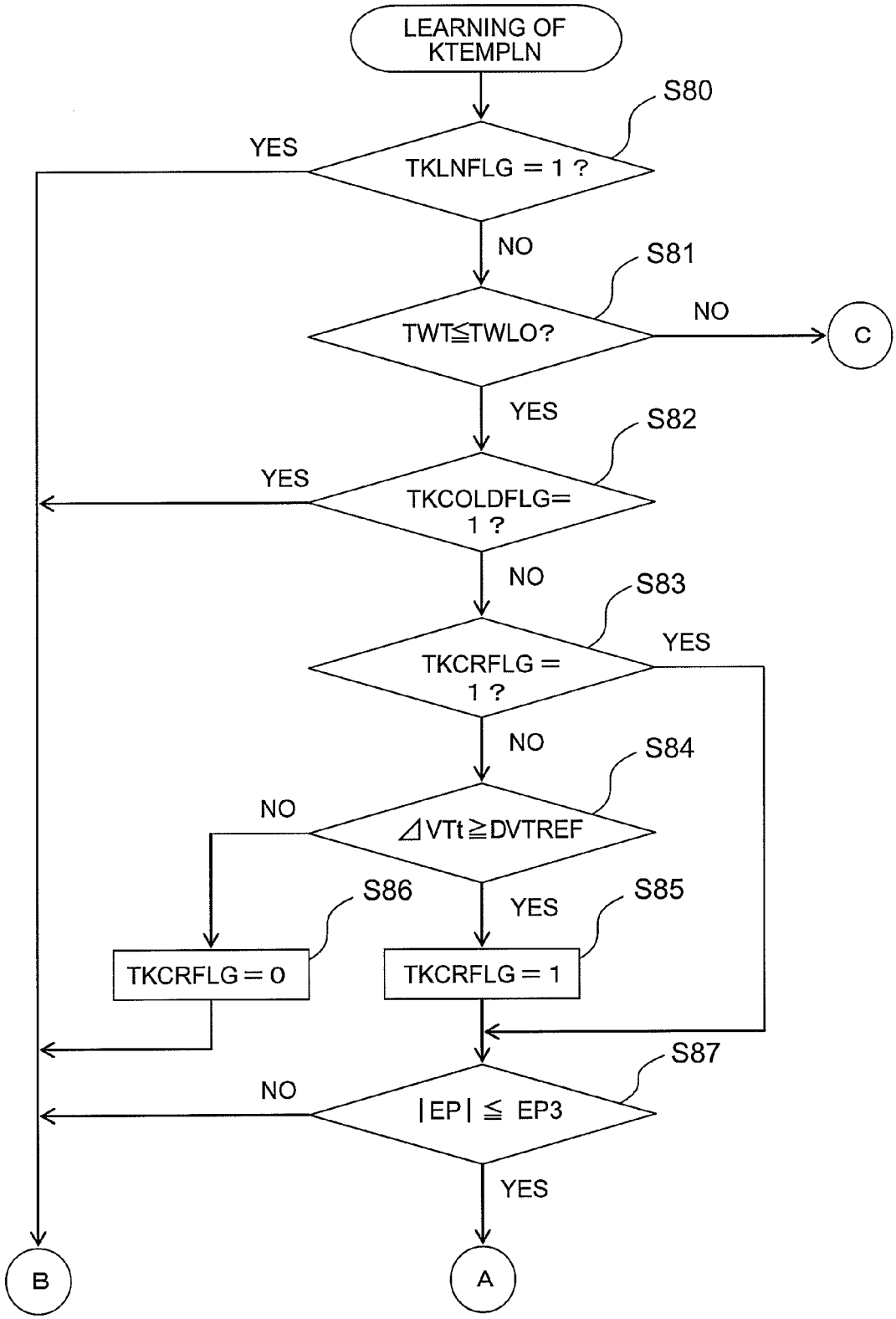
FIG. 11 is a flowchart showing learning processing of a KTEMPLN.
Figure 12:
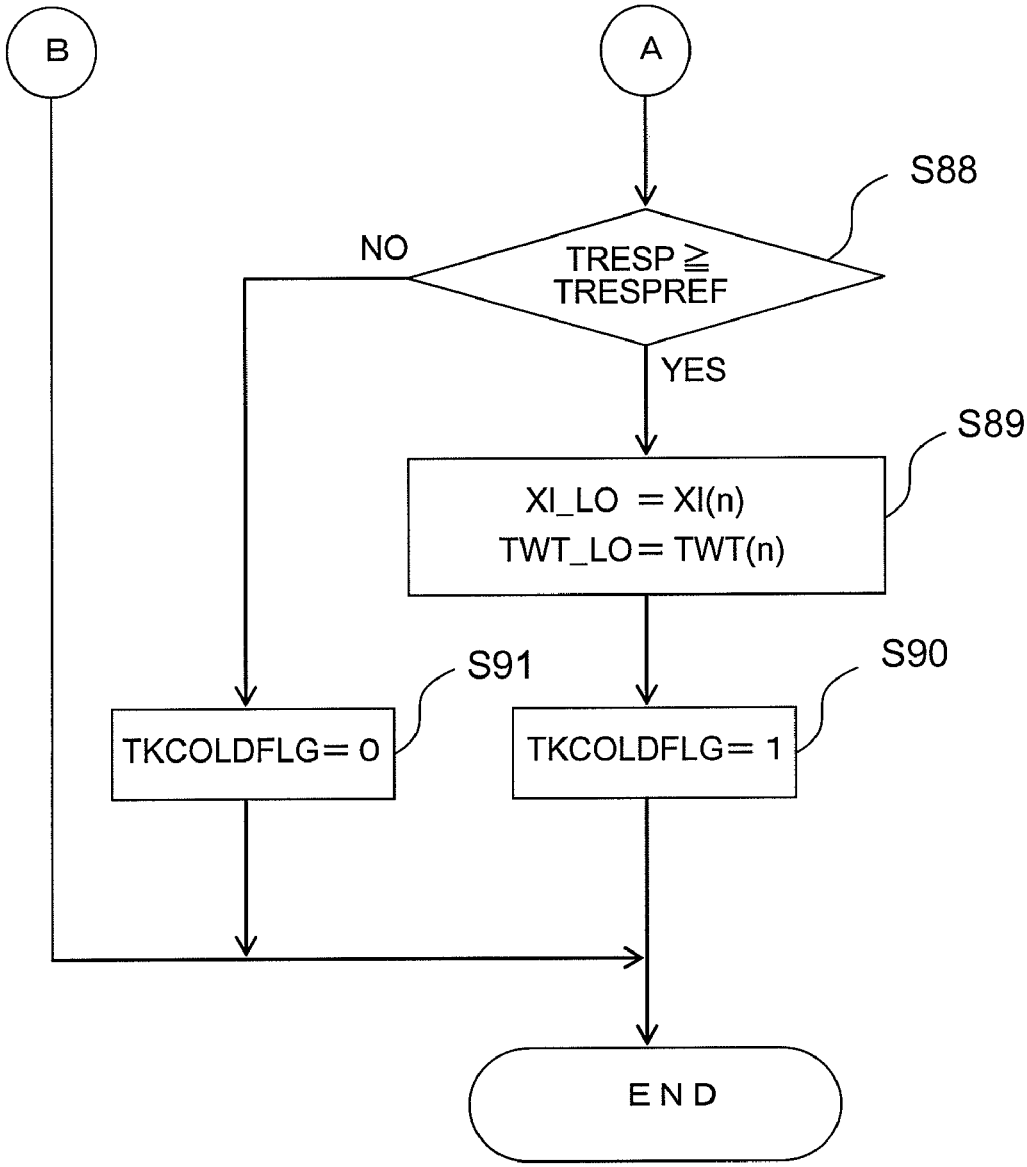
FIG. 12 is a flowchart subsequent to the flowchart of FIG. 11.
Figure 13:
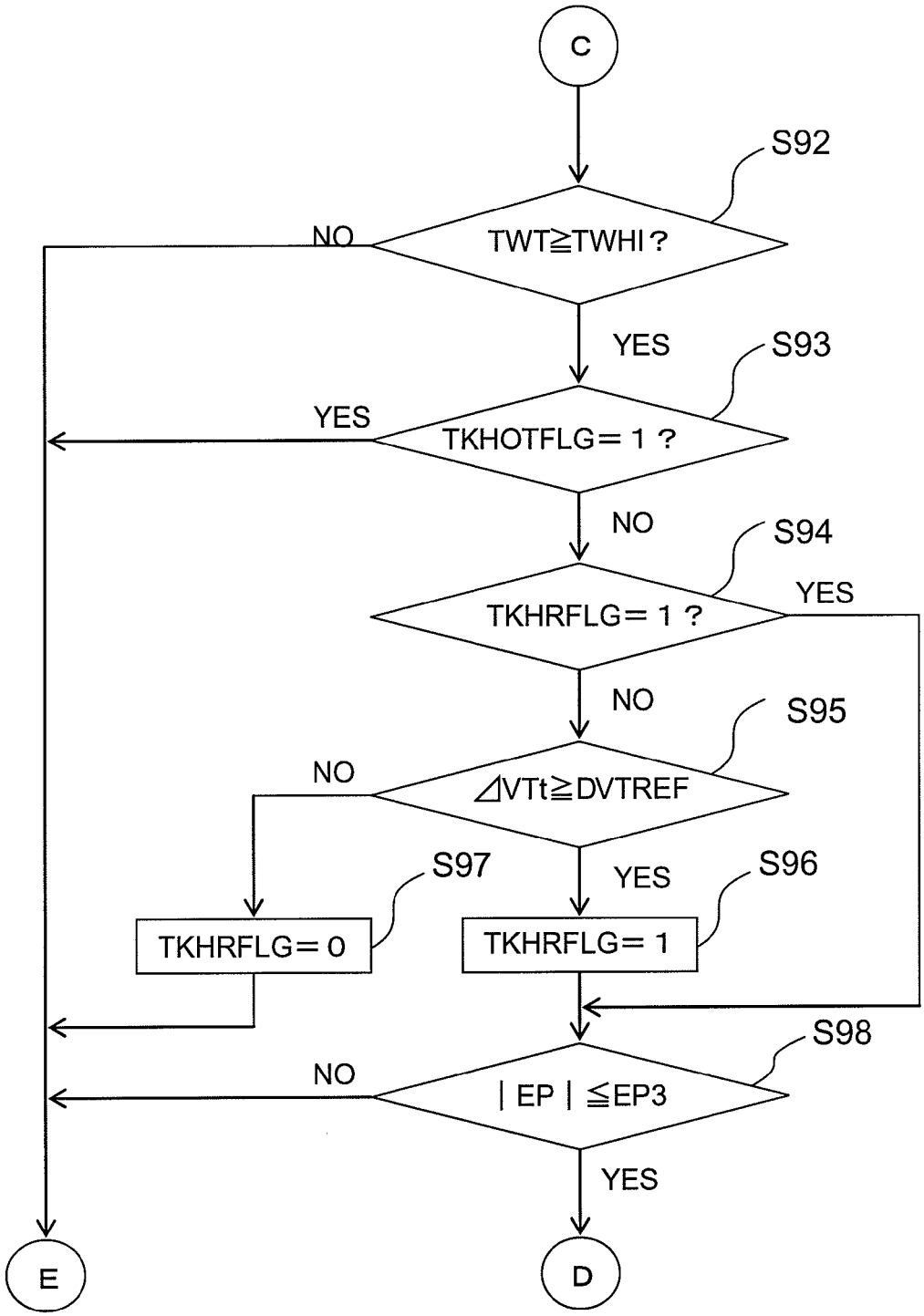
FIG. 13 is a flowchart subsequent to the flowchart of FIG. 12.
Figure 14:
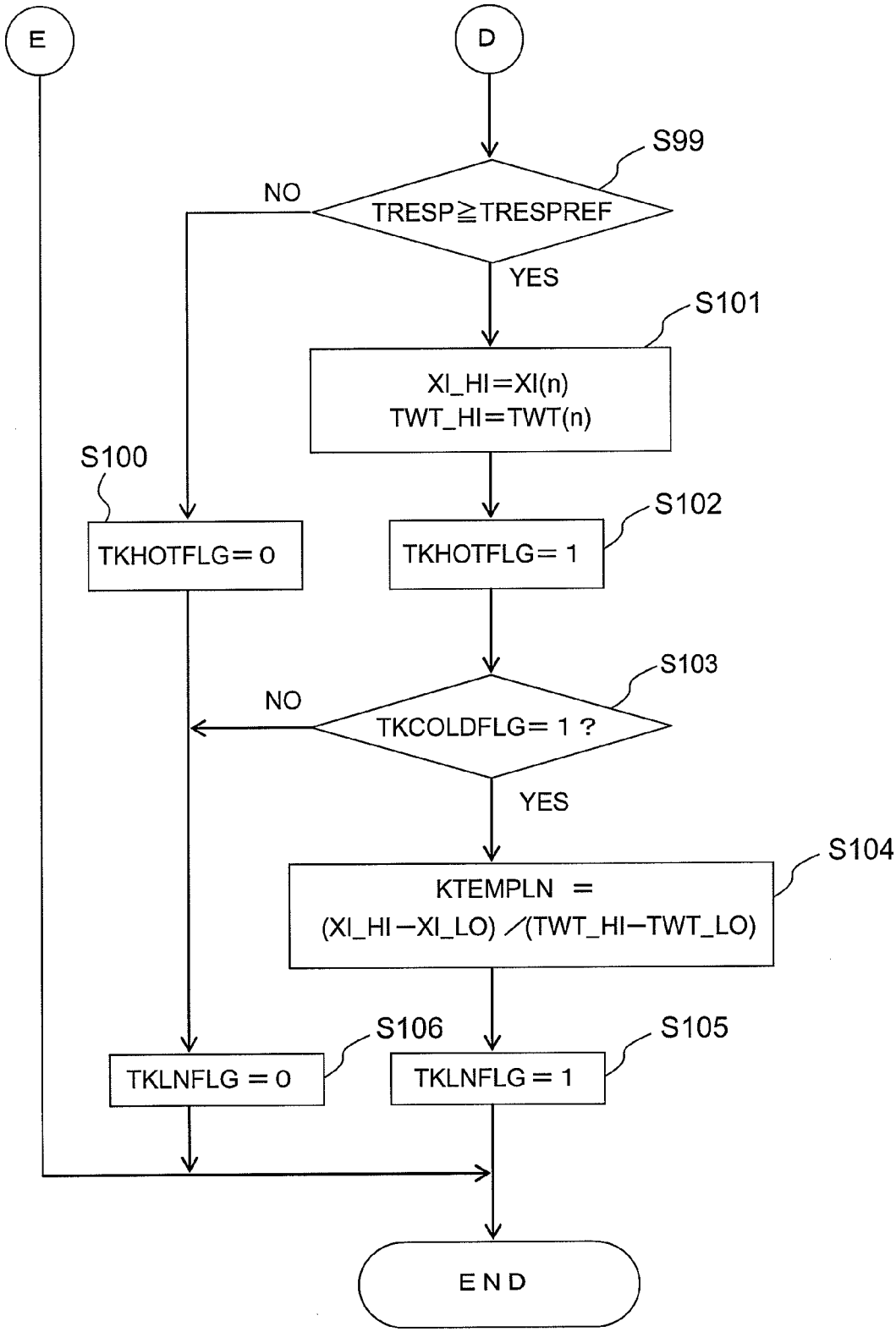
FIG. 14 is a flowchart subsequent to the flowchart of FIG. 13.

FIG. 10 shows a flowchart of the initial value setting processing of the integral term at the time of starting the phase angle feedback control. First, the microcomputer 21 determines whether the water temperature sensor (not shown) is in failure or not (Step S60), sets a given value (for example, 40° C.) to the water temperature data TWT when the water temperature sensor is in failure (Step S61), and sets a water temperature value that has been detected by the water temperature sensor when the water temperature sensor is normal (Step S62).

Then, the microcomputer 21 determines whether the PID control operation of the phase angle feedback control is initial or not (Step S63), and writes the integral term operation value XI(n) in the previous integral term operation value XI(n−1) and terminates the processing in the case where the PID control operation is the second or subsequent time (Steps S63 to S72).

In the case where the PID control operation is initial, the microcomputer 21 determines whether the PID control operation is executed after the battery is turned off (disconnection of a battery terminal) (Step S64). In the case where it is executed after the battery is turned off, the microcomputer 21 calculates the integral term initial value by the aid of a first operational expression represented by Expression 13 using the water temperature TWT, the temperature coefficient KTEMP, and the offset value XIOFST (Step S65).

$$XI_ini = KTEMP \times TWT \times XIOFST \quad (13)$$

A description will be given of a method of deriving the first operational expression of the integral term initial value operational expression represented by Expression 13. The relational expression of a tolerance lower limit value IH_OCVLO of the neutral position (position of the flow rate 0) control current value of the spool valve 32 of the OCV 3, a tolerance lower limit value R_SOLLO of the resistance of the linear solenoid coil 31 of the OCV 3, a given reference voltage (for example, 14 V) at the time of calculating the battery voltage correction coefficient KVB, and the operation quantity (DH_out) under the neutral position control of the spool valve 32 of the OCV 3 can be represented by Expression 14.

$$DH_out = IH_OCVLO \times R_SOLLO/14 \quad (14)$$

In Expression 14, the linear solenoid coil resistance tolerance lower limit value R_SOLLO also changes with a change in the linear solenoid coil temperature (estimated as the water temperature TWT). For that reason, the operation quantity (DH_out) under the neutral position control of the spool valve 32 of the OCV 3 also changes.

Figure 16:
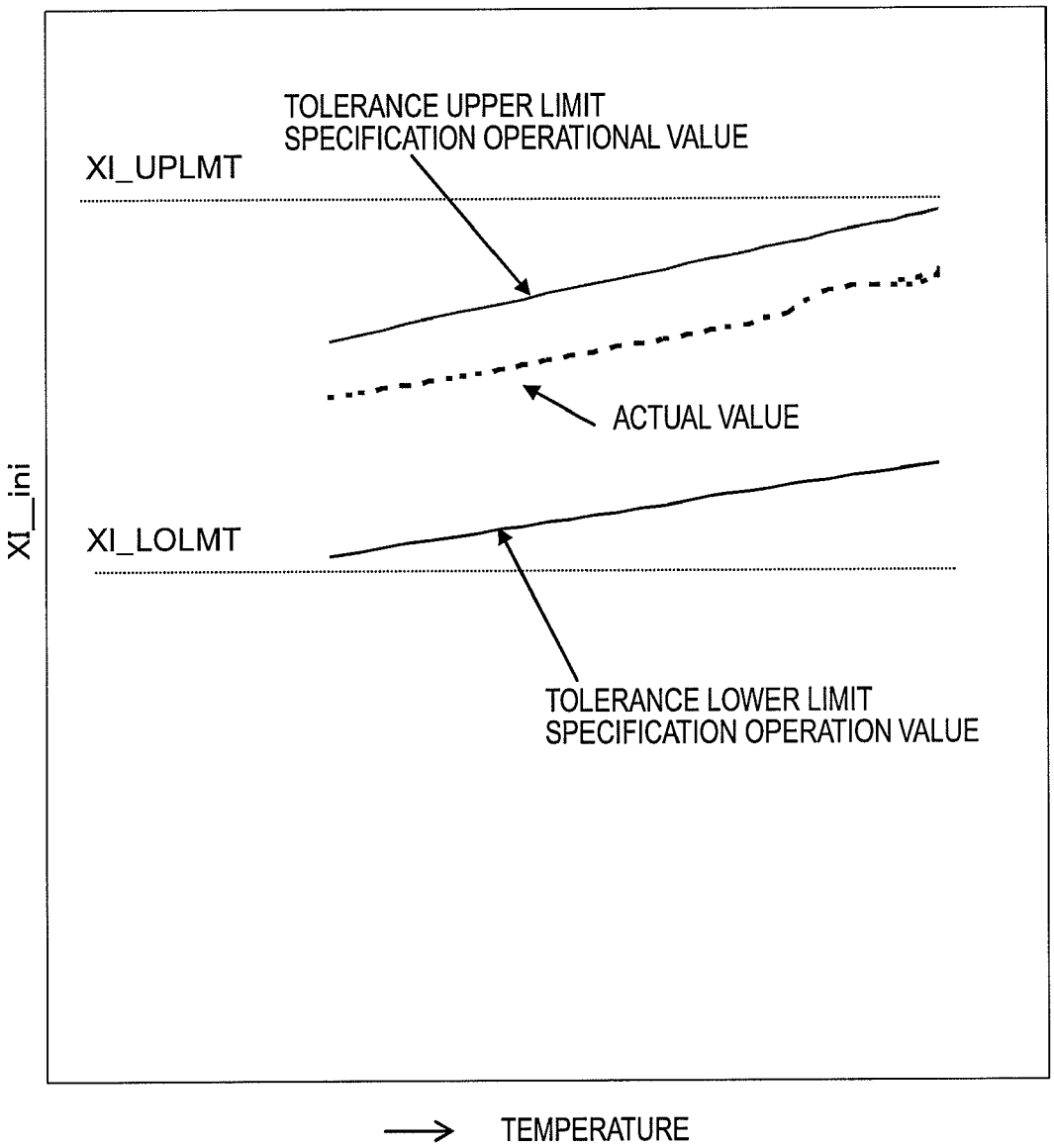
FIG. 16 is a graph showing a relationship between XI_ini and a temperature.

In FIG. 16, the operation quantity (DH_out) under the neutral position control of the spool valve 32 of the OCV 3 which is calculated through Expression 14 is set as the integral term initial value XI_ini. The operation value of the tolerance lower limit specification of the OCV3, the operation value of the tolerance upper limit specification, the actual value of the integral term when the real phase angle is converged to the target phase angle under the phase angle F/B control in the nominal specification product of the OCV 3 are plotted with respect to the temperature (the tolerance upper and lower limit specifications are at the linear solenoid coil temperature, and the nominal specification is at the water temperature TWT).

It is understood from FIG. 16 that the linear solenoid coil temperature can be estimated by the water temperature TWT. In the first operational expression that is the integral term initial value operational expression represented by Expression 13, the approximate expression of the integral term initial value XI_ini of the tolerance lower limit specification of the OCV 3 is found by the temperature coefficient KTEMP and the offset value XIOFST by the aid of the temperature characteristic of the integral term initial value shown in FIG. 16. In FIG. 16, XI_LOLMT expresses the lower limit value within the tolerance of the integral term initial value setting, and XI_UPLMT expresses the upper limit value within the tolerance.

Subsequently, in the case where the microcomputer 21 determines that it is not executed after the battery is turned off in Step S64, the microcomputer 21 calculates the integral term initial value XI_ini through a second operational expression (15) that is calculated by the aid of a learned value KTEMPLN of the temperature coefficient and a learned value XIOSTLN of the offset value, which are found by learning processing that will be described later at the time of implementing the phase angle F/B control in Step S66.

$$XI_ini = KTEMPLN \times TWT + XIOFSTLN \quad (15)$$

Then, the microcomputer 21 determines whether the integral term initial value XI_ini that is calculated through the first operational expression (13) and the second operational expression (15) is equal to or larger than the upper limit value XI_UPLMT within the tolerance or not (Step S67). In the case where the integral term initial value XI_ini is equal to or higher than the upper limit value XI_UPLMT within the tolerance, the microcomputer 21 sets the upper limit value XI_UPLMT in the integral term initial value XI_ini (Step S68). In the case where the former is not equal to or higher than the latter, the microcomputer 21 determines whether the integral term initial value XI_ini is equal to or lower than the lower limit value XI_LOLMT within the tolerance or not (Step S69). In the case where the integral term initial value XI_ini is equal to or lower than the lower limit value XI_LOLMT within the tolerance, the microcomputer 21 sets the lower limit XL_LOLMT in the integral term initial value XI_ini (Step S70). In the case where the integral term initial value XI_ini is within the tolerance upper and lower limit range, the microcomputer 21 sets the values calculated by the first operational expression (13) and the second operational expression (15) in the integral term initial value XI_ini, writes the integral term initial value XI_ini thus set in the previous integral term operation value XI(n−1) (Step S71), and terminates the processing.

FIGS. 11 to 14 show flowcharts of learning processing of the learned value KTEMPLN of the temperature coefficient which is learned based on the operation state (water temperature, the response time of the real phase angle, etc.) under the first phase angle feedback control after the key is turned on.

The microcomputer 21 determines whether the learned value KTEMPLN of the temperature coefficient has been completely learned (TKLNFLG=1) or not in Step S80. In the case of the learning completion (TKLNFLG=1), the microcomputer 21 completes the processing as it is. In the case where the learning has not yet been completed (TKLNFLG=0), the microcomputer 21 learns the learned value KTEMPLN of the temperature coefficient in the processing subsequent to Step S81.

In Step S81, the microcomputer 21 determines whether the operating state is a cold state or not, based on whether the water temperature TWT is equal to or lower than a given value TWLO (for example, 40° C.) at the lower temperature side or not (TWT≦TWLO?). In the case where the microcomputer 21 determines that the operating state is the cold state (TWT≦TWLO), the processing is advanced to Step S82, and in the case where the microcomputer 21 determines that the operating state is not the cold state, the processing is advanced to Step S92.

In Step S82, the microcomputer 21 determines whether the integral term data XI_LO and the water temperature data TWT_LO in the cold state (TWT≦TWLO), which is operation data of the learned value KTEMPLN of the temperature coefficient, have been completely read or not (TKCOLDFLG=1?). In the case where the data has been completely read in the cold state (TKCOLDFLG=1), the microcomputer 21 terminates the processing.

In the case where the data has not yet completely been read in the cold state in Step S82, the microcomputer 21 determines whether a read permission flag of the integral term data XI_LO and the water temperature data TWT_LO in the cold state (TWT≦TWLO) has been set or not in Step S83 (TKCRFLG=1?). In the case where the read permission flag has been set (TKCRFLG=1), the processing is advanced to Step S87.

In the case where the read permission flag has been cleared (TKCRFLG=0) in Step S83, the microcomputer 21 determines whether a target phase angle change ΔVTt(=VTt(n)−VTt(n−1)) is equal to or higher than a given value DVTREF (ΔVTt≧DVTREF) or not in Step S84. In the case where the target phase angle change ΔVTt(=VTt(n)−VTt(n−1)) is lower than the given value DVTREF, the microcomputer 21 clears the read permission flag (TKCRFLG=0) in Step S86, and terminates the processing. In the case where the target phase angle change ΔVTt(=VTt(n)−VTt(n−1)) is equal to or higher than the given value DVTREF, the microcomputer 21 sets the read permission flag (TKCRFLG=1) in Step S85, and the processing is advanced to Step S87.

In Step S87, the microcomputer 21 determines whether an absolute value of the phase angle deviation EP is equal to or lower than the given value EPREF or not. In the case where the absolute value of the phase angle deviation EP is not lower than the given value EPREF (|EP|>EPREF), the microcomputer 21 terminates the processing as it is because the real phase angle is not converged to the target phase angle. In the case where the absolute value of the phase angle deviation EP is equal to or lower than the given value EPREF (|EP|≦EPREF), the microcomputer 21 determines whether the convergence time TRESP of the real phase angle is equal to or higher than the given value TRESPREF or not in Step S88.

In the case where the convergence time TRESP of the real phase angle is equal to or higher than the given value TRESPREF (TRESP≧TRESPREF) in Step S88, the microcomputer 21 writes the operation value XI(n) of the present integral term under the phase angle F/B control into the integral term initial value XI_LO at the cold time in Step S89, and writes the present read value of the water temperature TWT (I(n)) into the water temperature value TWT_LO at the cold time. Then, the microcomputer 21 sets a read completion flag of the integral term data XI_LO and the water temperature data TWT_LO in the cold state (TKCOLDFLG=1) in Step S90, and terminates the processing.

On the other hand, in the case where the microcomputer 21 determines the convergence time of the real phase angle is lower than the given value TRESPREF in Step S88, the microcomputer 21 clears the read completion flag of the integral term data XI_LO and the water temperature data TWT_LO (TKCOLDFLG=0) in Step S91, and terminates the processing.

In the case where the microcomputer 21 determines that the operating state is not the cold state in Step S81, the microcomputer 21 determines whether the operating state is a warm state or not (TWT≧TWHI?) in Step S92. In the case where the microcomputer 21 determines that the operating state is not the warm state (TWT<TWHI), the microcomputer 21 terminates the processing as it is. In the case where the microcomputer 21 determines that the operating state is the warm state (TWT≧TWHI), the microcomputer 21 advances the processing to Step S93.

In Step S93, the microcomputer 21 determines whether the integral term data XI_HI and the water temperature data TWT_HI in the warm state (TWT≧TWHI), which is operation data of the learned value KTEMPLN of the temperature coefficient, have been completely read or not (TKHOTFLG=1?). In the case where the data has been completely read in the warm state (TKHOTFLG=1), the microcomputer 21 terminates the processing.

In the case where the data has not yet completely been read in the warm state in Step S93, the microcomputer 21 determines whether a read permission flag of the integral term data XI_HI and the water temperature data TWT_HI in the warm state (TWT≧TWHI) has been set or not in Step S94 (TKHRFLG=1?). In the case where the read permission flag has been set (TKHRFLG=1), the processing is advanced to Step S98.

In the case where the read permission flag has been cleared (TKHRFLG=0) in Step S94, the microcomputer 21 determines whether the target phase angle change ΔVTt(=VTt(n)−VTt(n−1)) is equal to or higher than the given value DVTREF (ΔVTt≧DVTREF) or not in Step S95. In the case where the target phase angle change ΔVTt(=VTt(n)−VTt(n−1)) is lower than the given value DVTREF, the microcomputer 21 clears the read permission flag (TKHRFLG=0) in Step S97, and terminates the processing. In the case where the target phase angle change ΔVTt(=VTt(n)−VTt(n−1)) is equal to or higher than the given value DVTREF, the microcomputer 21 sets the read permission flag (TKHRFLG=1) in Step S96, and the processing is advanced to Step S98.

In Step S98, the microcomputer 21 determines whether the absolute value of the phase angle deviation EP is equal to or lower than the given value EPREF or not. In the case where the absolute value of the phase angle deviation EP is not lower than the given value EPREF (|EP|>EPREF), the microcomputer 21 terminates the processing as it is because the real phase angle is not converged to the target phase angle. In the case where the absolute value of the phase angle deviation EP is equal to or lower than the given value EPREF (|EP|≦EPREF), the microcomputer 21 determines whether the convergence time TRESP of the real phase angle is equal to or higher than the given value TRESPREF or not in Step S99.

In the case where the convergence time TRESP of the real phase angle is lower than the given value TRESPREF (TRESP<TRESPREF) in Step S99, because it is unnecessary to learn the temperature coefficient TKTEMP, the microcomputer 21 clears the read completion flag of the integral term data XI_HI and the water temperature data TWT_HI (TKHOTFLG=0) in the warm state in Step S100. Then, the microcomputer 21 clears the learning completion flag of the learned value KTEMPLN of the temperature coefficient (TKLNFLG=0) in Step S106, and terminates the processing.

In the case where the microcomputer 21 determines that the convergence time TRESP of the real phase angle is equal to or higher than the given value TRESPREF (TRESP≧TRESPREF) in Step S99, the microcomputer 21 writes the operation value XI(n) of the current integral term under the phase angle F/B control into the integral term initial value XI_HI at the warm time and the current water temperature reading value TWT(n) in the water temperature value TWT_HI at the warm time in Step S101. Then, the microcomputer 21 sets the read completion flag of the integral term data XI_HI and the water temperature data TWT_HI in the warm state (TKHOTFLG=1) in Step S102. Then, in Step S103, the microcomputer 21 determines whether the read completion flag of the integral term data XI_LO and the water temperature data TWT_LO in the cold state has been set or not.

When it is determined that the read completion flag has been set in Step S103 (TKCOLDFLG=1), the microcomputer 21 conducts the learning operation of the learned value TKTEMPLN of the temperature coefficient in Step S104. When it is determined that the read completion flag in the cold state has been cleared (TKCOLDFLG=0) in Step S103, the microcomputer 21 clears the learning completion flag of the learned value KTEMPLN of the temperature coefficient (TKLNFLG=0) in Step S106 and terminates the processing.

In Step S104, the microcomputer 21 calculates the learned value KTEMPLN of the temperature coefficient by an operational expression represented by Expression 16, using of the integral term data XI_LO and the water temperature data TWT_LO in the cold state as well as the integral term data XI_HI and the water temperature data TWT_HI in the warm state, and learns the calculated learned value KTEMPLN of the temperature coefficient.

$$KTEMPLN=(X1_HI-XI_LO)/(TWT_HI_TWT_LO) \quad (16)$$

Subsequently, the microcomputer 21 sets the learning completion flag of the learned value KTEMPLN of the temperature coefficient (TKLNFLG=1) in Step S105, and terminates the processing.

As described above by dividing, a difference value in the integral term operation value between the cold time and the warm time in a state where the real phase angle is converged to the target phase angle by a difference value in the water temperature, the learned value of the temperature coefficient of the second operational expression of the integral term initial value operation is obtained. As a result, it is possible to learn the individual difference of the OCV3.

Figure 15:
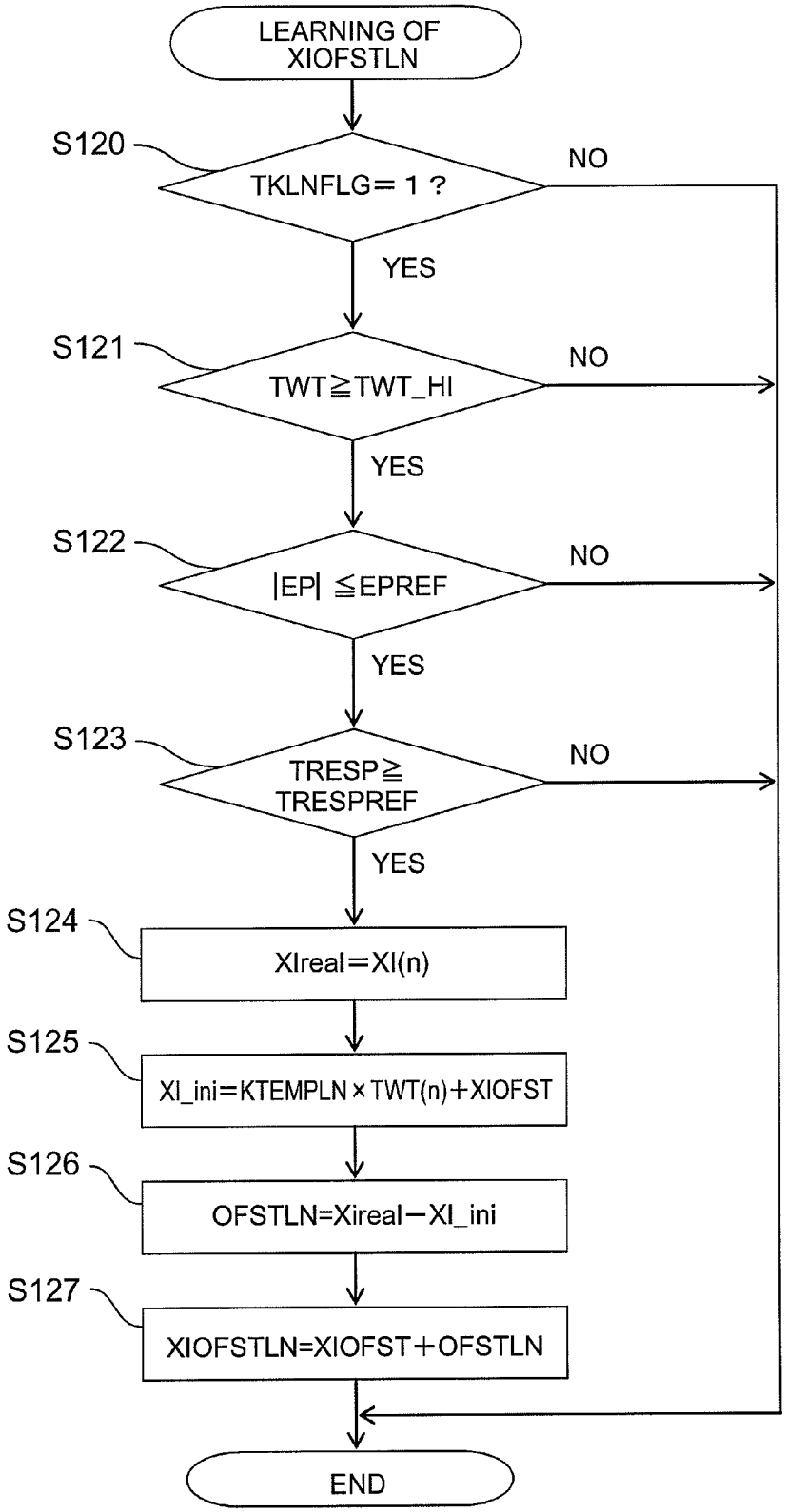
FIG. 15 is a flowchart showing learning processing of an XIOFSTLN.

FIG. 15 shows a flowchart of learning processing of the learned value XIOFSTLN of the offset value for learning based on the actual value XIreal of the integral term in the state where the real phase angle is converged to the target phase angle under the phase angle feedback control, and the integral term initial value XI_ini that is calculated using the first operational expression of the integral term initial value operation that uses the learned value KTEMPLN of the temperature coefficient.

In Step S120 of FIG. 15, the microcomputer 21 determines whether the learned value KTEMPLN of the temperature coefficient has been completely learned, or not (TKLNFLG=1?). In the case where the learned value KTEMPLN of the temperature coefficient has not yet been learned (TKLNFLG=0), the microcomputer 21 directly terminates the processing. In the case where the learned value KTEMPLN of the temperature coefficient has been completely learned (TKLNFLG=1), the microcomputer 21 determines whether the operation state is the warm state, or not (TWT≧TWT_HI?) in Step S121. In the case where the operation state is not the warm state, the microcomputer 21 terminates the processing. In the case where the operation state is the warm state (TWT≧TWT_HI), the microcomputer 21 determines whether the absolute value of the phase angle deviation is equal to or lower than a given value, or not (|EP|≦EPREF) in Step S122.

In the case where the absolute value of the phase angle deviation is not converged at the given value or lower in Step S122 (|EP|>EPREF), the microcomputer 21 terminates the processing. In the case where the absolute value of the phase angle deviation is equal to or lower than a given value (|EP|≦EPREF), the microcomputer 21 determines whether the convergence time of the real phase angle is equal to or higher than a given value, or not, in Step S123 (TRESP≧TRESPREF). In the case where the real phase angle is converged within a given period of time (TRESP<TRESPREF), the microcomputer 21 directly terminates the processing. In the case where the convergence time is equal to or higher than the given value (TRESP≧TRESPREF), the microcomputer 21 writes the current integral term operation value XI(n) that is under the phase angle F/B control into the integral term actual value XIreal (Step S124).

After that, the microcomputer 21 calculates the integral term initial value XI_ini (=KTEMPLN×TWT(n)+XIOFST) by the first operational expression of the integral term initial value operation using the current water temperature TWT(n) and the learned value KTEMPLN of the temperature coefficient in Step S125. Then, the microcomputer 21 learns a difference OFSTLN (=XIreal−XI_ini) between the integral term actual value XIreal and the calculated integral term initial value XI_ini as in Step S126. In Step 127, the microcomputer 21 learns the learned value XIOFSTLN of the offset value as XIOFSTLN=XIOFST+OFSTLN, and terminates the processing.

As described above, the learned value XIOFSTLN of the offset value is calculated based on the integral term actual value XIreal under the phase angle F/B control in the state where the real phase angle is converged to the target phase angle in the warm state, and the integral term initial value XI_ini that has been calculated by the learned value KTEMPLN of the temperature coefficient and the first operational expression of the integral term initial value operation. Thus, it is possible to learn the individual difference of the OCV 3.

Figure 17:
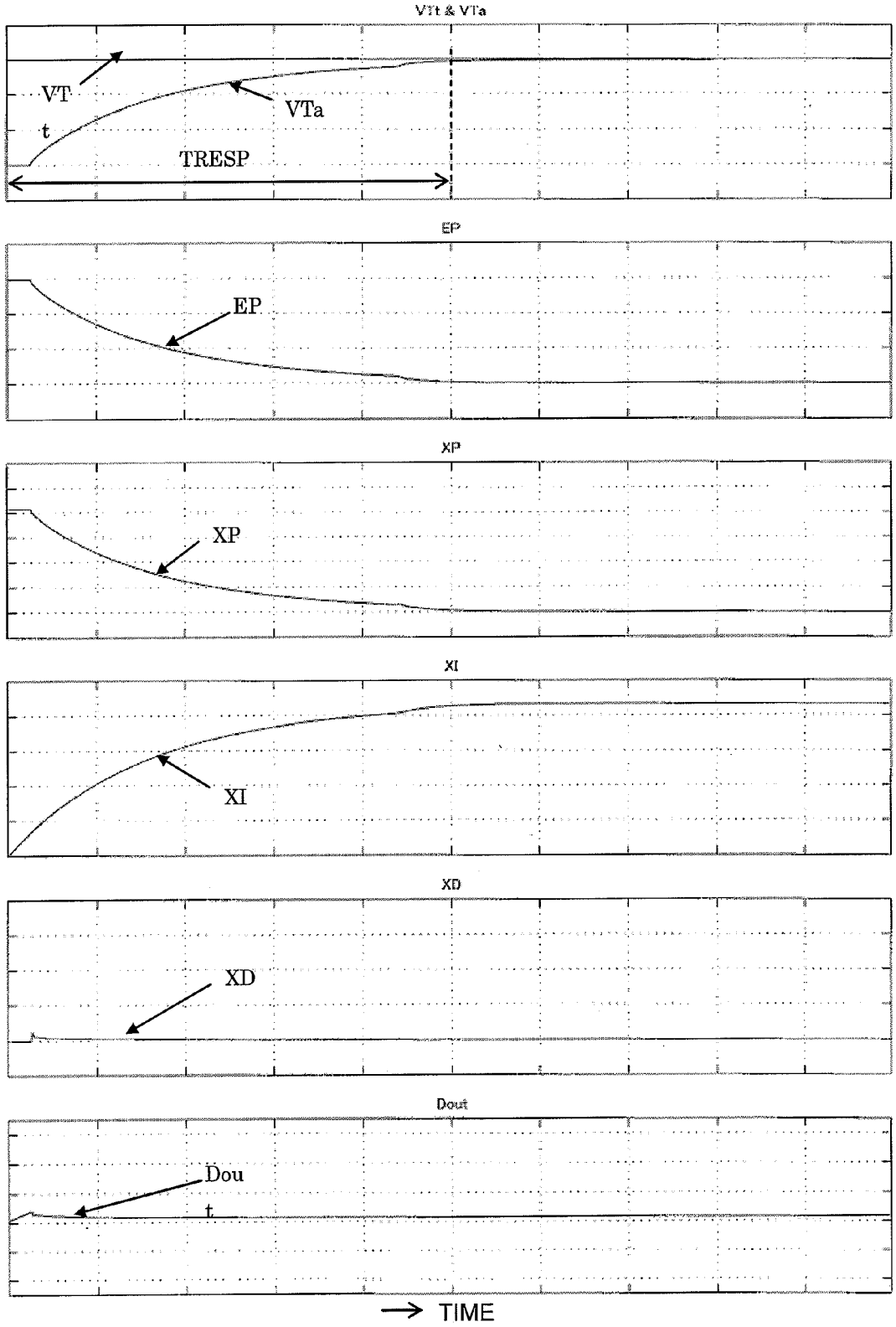
FIG. 17 is a timing chart showing a phase angle response in a case of XI_ini=0.

FIG. 17 shows a phase angle response time chart in the case where the integral term initial value XI_ini is 0. Because the integral term initial value XI_ini=0 is met at the time of starting the phase angle F/B control, the oil supply quantity to the advance chamber side of the spool valve 32 of the OCV 3 is short until the integral term XI reaches an equilibrium state. As a result, the convergence time TRESP of the real phase angle is extended.

Figure 18:
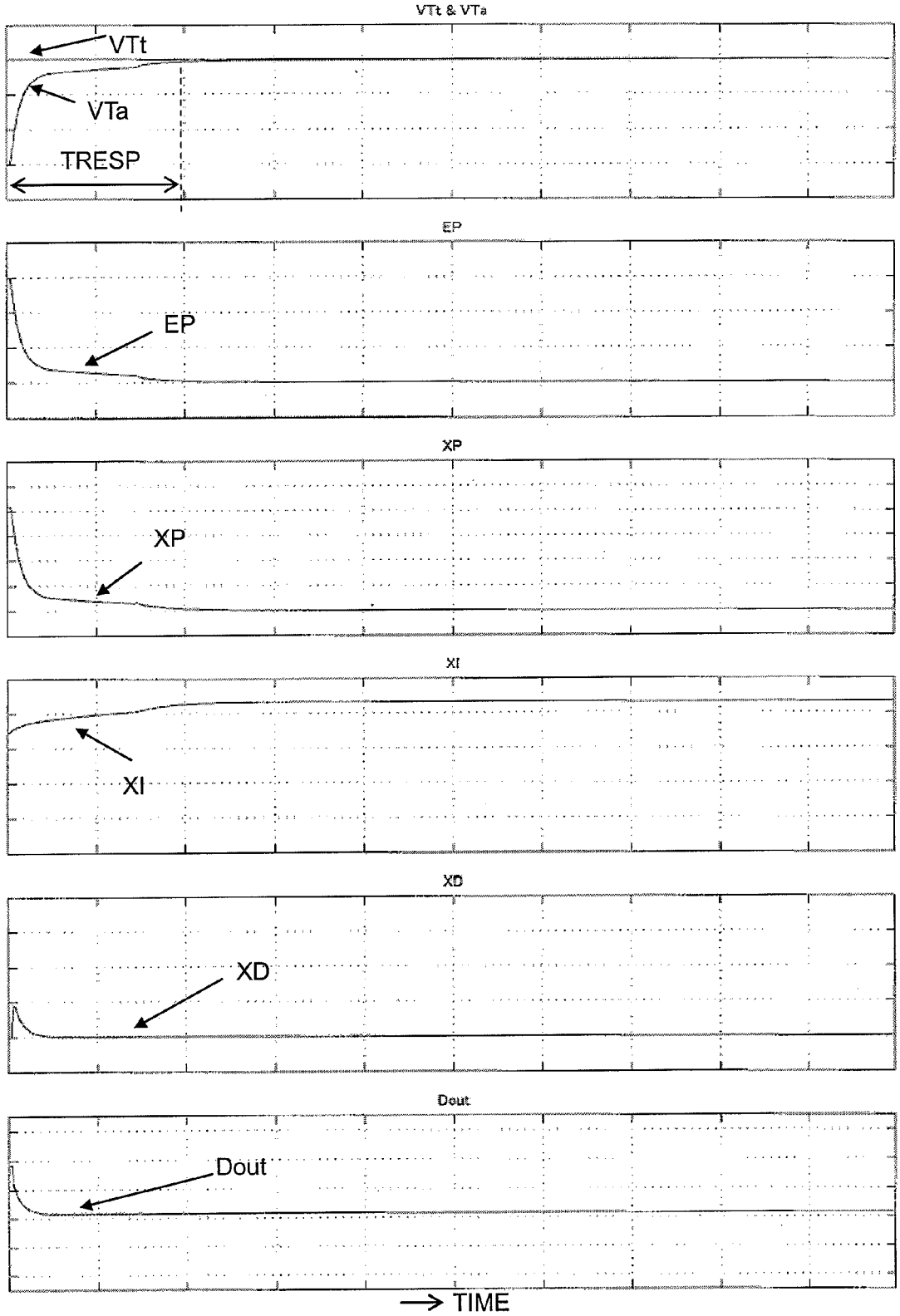
FIG. 18 is the timing chart showing the phase angle response at a time of setting XI_ini by the aid of a first arithmetic expression.

FIG. 18 shows a phase angle response time chart in the case of calculating the integral term initial value XI_ini at the time of starting the phase angle F/B control by using the first operational expression that is an integral term initial value operational expression which has been set in the tolerance lower limit specification of the OCV 3, and setting the calculated integral term initial value XI_ini. The convergence time TRESP of the real phase angle is reduced to about ⅖ of that in FIG. 17.

Figure 19:
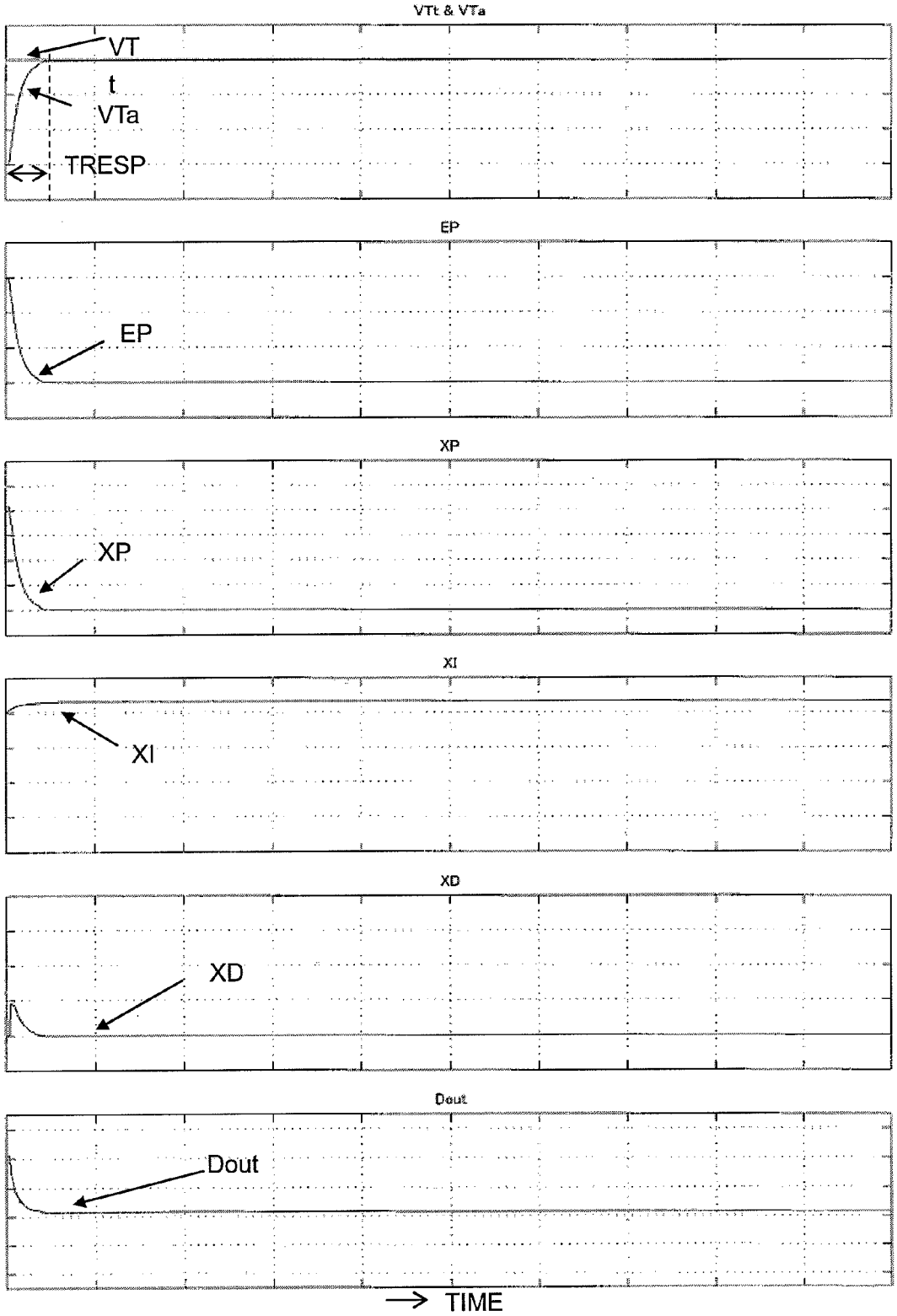
FIG. 19 is the timing chart showing the phase angle response at a time of setting XI_ini by the aid of a second arithmetic expression.

FIG. 19 shows a phase angle response time chart in the case of calculating the integral term initial value XI_ini at the time of starting the phase angle F/B control by using the second operational expression using the learned value of the temperature coefficient and the offset value, with respect to the first operational expression used in FIG. 18. The convergence time TRESP of the real phase angle is reduced to about ¼ of that in FIG. 18. The convergence time is reduced to about 1/10 of that in the case where the integral term initial value XI_ini is 0 (FIG. 17).

As described above, according to the present invention, the initial value of the integral term at the time of starting the phase angle feedback control operation is set based on the temperature parameter of the internal combustion engine, and the control correction quantity that has been calculated through the feedback control operation is corrected in voltage by the battery voltage, to output the operation quantity with respect to the hydraulically controlled solenoid valve. As a result, the actual position of the hydraulically controlled solenoid valve in a retention state is prevented from being deviated from the original neutral position toward the advance side. Further, even in the case where the target phase angle is set on the advance side where the valve overlap of the intake valve and the exhaust valve is originally large, the valve overlap does not become excessive and the startability of the internal combustion engine can be prevented from being deteriorated due to an excess internal EGR quantity. Further, because it is unnecessary to limit the target phase angle toward the advance side, there is an effect that the startability at a low temperature is improved.

Further, the initial value of the integral term is calculated and set by using the preset operational expression with the temperature parameter of the internal combustion engine as an input. Thus, setting of the initial value of the integral term at the time of starting the phase angle feedback control according to the temperature or the voltage state at the time of starting the internal combustion engine can be carried out with a simple control logic, and the precision can also be ensured. Accordingly, it is possible to prevent excessive overshoot of the real phase angle at the time of the phase angle feedback control, and the valve overlap of the intake valve and the exhaust valve is prevented from becoming excessive. For those reasons, stable combustion is ensured.

Further, since the temperature parameter of the internal combustion engine is the water temperature data, the water temperature data from an existing water temperature sensor within the internal combustion engine can be diverted, thereby making it possible to prevent the costs from unnecessarily increasing.

Further, the first operational expression of the initial value operation of the integral term is an operational expression that is derived and set in advance based on the tolerance lower limit value of the neutral position control current value of the hydraulically controlled solenoid valve, the tolerance lower limit value of the solenoid coil resistance of the hydraulically controlled solenoid valve, and the solenoid coil temperature. For that reason, the initial value of the integral term at the time of starting the phase angle feedback control can be set with a simple control logic and the precision can also be ensured, with respect to the temperature or the voltage state at the time of starting the internal combustion engine and the individual variation of the hydraulically controlled solenoid valve (referred to as "OCV"). With the above configuration, it is possible to prevent excessive overshoot of the real phase angle at the time of starting the phase angle feedback control, and the valve overlap of the intake valve and the exhaust valve is prevented from becoming excessive. For that reason, the stable combustion is ensured.

Further, in the first operational expression for calculating the initial value of the integral term, since the offset value is added to the water temperature multiplied by the temperature coefficient, it is possible to carry out setting of the initial value of the integral term that corresponds to a change in the temperature or voltage with the simple control logic.

Further, the initial value of the integral term at the time of starting the first phase angle feedback control operation is calculated and set by the first operational expression after the connection of a battery power supply. Therefore, even in the case where the learned value is lost as in the case where the battery is turned off, it is possible to set the initial value of the integral term according to the temperature or voltage stage.

Further, the initial value of the integral term at the time of starting the second and subsequent phase angle feedback control operations is calculated and set by the second operational expression using the learned values of the temperature coefficient and offset value of the first operational expression, after the connection of the battery power supply. As a result, even if the temperature or voltage state is changed, there is an effect that both of an improvement in the response and the suppression of the overshoot quantity at the time of starting the phase angle F/B control can be achieved.

Further, the temperature coefficient of the second operational expression for calculating the initial value of the integral term is learned by dividing the difference value in the actual value of the integral term between the warm region and the cold region by the difference value in the water temperature value based on the actual value and the water temperature value of the integral term when the real phase angle is converged to the target phase angle by the phase angle feedback control in the cold region and the warm region which are determined according to the water temperature. As a result, even if the temperature or the voltage state is changed, both of an improvement in the response and the suppression of the overshoot quantity at the time of starting the phase angle F/B control can be achieved.

Further, the offset value in the second operational expression for calculating the initial value of the integral term is learned according to the difference between the actual value of the integral term when the real phase angle is converged to the target phase angle by the phase angle feedback control, and the initial value of the integral term which is obtained by adding the offset value to the water temperature value at the time of convergence, which is multiplied by the learned value of the temperature coefficient, in the warm region that is determined according to the water temperature after the completion of the temperature coefficient learning. As a result, even if the temperature or the voltage state is changed, both of an improvement in the response and the suppression of the overshoot quantity at the time of starting the phase angle F/B control can be achieved.

Further, when the failure of the water temperature sensor for detecting the operating state of the internal combustion engine is determined, the initial value of the integral term is calculated and set by the first operational expression with the water temperature as the predetermined value. Thus, it is possible to prevent the excessive overshoot of the real phase angle at the time of starting the phase angle feedback control.

In addition, in the case where the operational value of the initial value of the integral term is outside the preset range of the upper limit value and the lower limit value of the initial value of the integral term, the initial value of the integral term is limited by the upper limit value or the lower limit value. As a result, it is possible to prevent the initial value of the integral term from being set to a value that exceeds the upper and lower limit range of the individual variation tolerance of the hydraulically controlled solenoid valve or the upper and lower limit range of the operating temperature thereof.

In the present invention, the initial value of the integral term is calculated by the operational expression based on the water temperature. Alternatively, the initial value of the integral term may be read from a water temperature table. Further, the solenoid coil temperature of the OCV 3 is estimated by the water temperature. Alternatively, the solenoid coil temperature may be estimated by the oil temperature that has been detected by the oil temperature sensor. Further, in the present invention, both of the temperature coefficient and the offset value of the integral term initial value operational expression are learned. However, even if only the offset value is learned, the same effects can be obtained.

What is claimed is:

1. A control device for an internal combustion engine, for changing a valve switching timing of at least one of an intake valve and an exhaust valve by changing a variable mechanism that enables continuous changing of a rotation phase of a cam shaft with respect to a crank shaft of the internal combustion engine by a hydraulically controlled solenoid valve through hydraulic driving, the control device comprising:

a crank angle sensor for detecting a reference rotation position of the crank shaft;

a cam angle sensor for detecting a reference rotation position of the cam shaft;

real phase angle detecting means for detecting a real phase angle of the cam shaft based on a detection signal of the crank angle sensor and the cam angle sensor;

target phase angle setting means including a temperature parameter and a battery voltage, for setting a target phase angle of the cam shaft based on an operating state of the internal combustion engine; and phase angle feedback control means for conducting a feedback control operation so that the real phase angle coincides with the target phase angle, and for calculating an operation quantity with respect to the hydraulically controlled solenoid valve, wherein the phase angle feedback control means sets an initial value of an integral term at a time of starting the phase angle feedback control operation based on the temperature parameter of the internal combustion engine, corrects a control correction quantity that has been calculated by the feedback control operation according to the battery voltage, and outputs the operation quantity with respect to the hydraulically controlled solenoid valve.

2. The control device for an internal combustion engine according to claim 1, wherein the phase angle feedback control means calculates and sets the initial value of the integral term by using a preset operational expression with the temperature parameter of the internal combustion engine as an input.

3. The control device for an internal combustion engine according to claim 1, wherein the temperature parameter of the internal combustion engine comprises a water temperature.

4. The control device for an internal combustion engine according to claim 1, wherein the operational expression of the initial value of the integral term comprises a first operational expression that is set based on a tolerance lower limit value of a neutral position control current value of the hydraulically controlled solenoid valve, a tolerance lower limit value of a solenoid coil resistance of the hydraulically controlled solenoid valve, and a solenoid coil temperature.

5. The control device for an internal combustion engine according to claim 4, wherein the first operational expression adds an offset value to the water temperature multiplied by a temperature coefficient.

6. The control device for an internal combustion engine according to claim 5, wherein the phase angle feedback control means calculates and sets an initial value of an integral term at a time of starting a first phase angle feedback control operation by using the first operational expression after a connection of a battery power supply.

7. The control device for an internal combustion engine according to claim 5, wherein the phase angle feedback control means calculates and sets an initial value of an integral term at times of starting a second and subsequent phase angle feedback control operations by using a second operational expression using learned values of the temperature coefficient and offset value of the first operational expression, after a connection of a battery power supply.

8. The control device for an internal combustion engine according to claim 7, wherein the phase angle feedback control means learns the temperature coefficient of the second operational expression by dividing a difference value in an actual value of the integral term between a warm region and a cold region by a difference value of a water temperature value based on the actual value and the water temperature value of the integral term when the real phase angle is converged to the target phase angle according to the phase angle feedback control operation in the cold region and the warm region which are determined according to the water temperature.

9. The control device for an internal combustion engine according to claim 7, wherein the phase angle feedback control means learns the offset value of the second operational expression by a difference between an actual value of the integral term when the real phase angle is converged to the target phase angle according to the phase angle feedback control operation, and the initial value of the integral term obtained by adding the offset value to a water temperature value at the time of convergence which is multiplied by the learned value of the temperature coefficient in a warm region that is determined according to the water temperature after the temperature coefficient has been learned.

10. The control device for an internal combustion engine according to claim 1, wherein the phase angle feedback control means calculates and sets the initial value of the integral term by using the first operational expression with the water temperature being a predetermined value when it is determined that a water temperature sensor for detecting the operating state of the internal combustion engine is in failure.

11. The control device for an internal combustion engine according to claim 1, wherein the phase angle feedback control means limits the setting of the initial value of the integral term to one of the upper limit value and the lower limit value in a case where an operation value of the initial value of the integral term is outside a preset range of the upper limit value and a preset range of the lower limit value of the initial value of the integral term.

* * * * *